US005979056A

United States Patent [19]

Andrews

[11] Patent Number: 5,979,056

[45] Date of Patent: Nov. 9, 1999

[54] BODY SHAVING DEVICE WITH CURVED RAZOR BLADE STRIP

[76] Inventor: Edward A. Andrews, 6835 Beach Rd., Troy, Mich. 48098

[21] Appl. No.: 08/739,990

[22] Filed: Oct. 29, 1996

Related U.S. Application Data

[63] Continuation-in-part of application No. 08/739,364, Oct. 28, 1996, which is a continuation-in-part of application No. 08/473,473, Jun. 7, 1995, Pat. No. 5,568,688.

[51] Int. Cl.[6] ..... B26B 21/56

[52] U.S. Cl. ..... 30/49; 30/50; 30/51; 30/356

[58] Field of Search ..... 30/49, 346.5, 50, 30/51, 55, 74.1, 356

[56] References Cited

U.S. PATENT DOCUMENTS

| | | | |
|---|---|---|---|
| 636,231 | 10/1899 | Hoglund . | |
| 658,774 | 10/1900 | Grier . | |
| 951,456 | 3/1910 | Saxton . | |
| 952,216 | 3/1910 | Saxton . | |
| 1,008,648 | 11/1911 | Kiefer . | |
| 1,171,290 | 2/1916 | Wild . | |
| 1,264,605 | 4/1918 | Bonham . | |
| 1,382,301 | 6/1921 | McCaffrey . | |
| 1,471,970 | 10/1923 | McElroy . | |
| 1,589,826 | 2/1926 | Strand . | |
| 1,598,189 | 8/1926 | Addison . | |
| 1,642,338 | 9/1927 | Holtzman . | |
| 1,690,557 | 11/1928 | Smith | 30/49 |
| 1,974,568 | 9/1934 | Grotenhuis | 30/49 |
| 2,008,591 | 7/1935 | Ohmer . | |
| 2,026,229 | 10/1935 | Gratiot . | |
| 2,319,361 | 5/1943 | Wiseley | 30/49 |
| 2,421,205 | 5/1947 | Kingsley | 30/49 |
| 2,545,533 | 3/1951 | Stewart | 30/49 |
| 2,810,953 | 10/1957 | Brody . | |
| 2,983,045 | 5/1961 | Diatikar, Jr. . | |
| 3,109,237 | 11/1963 | Girouard . | |
| 3,407,496 | 10/1968 | Pomper | 30/49 |
| 4,208,791 | 6/1980 | Van Vleve | 30/49 |
| 4,443,939 | 4/1984 | Motta et al. . | |
| 4,514,903 | 5/1985 | Pope | 30/49 |
| 4,516,320 | 5/1985 | Peleckis . | |
| 4,720,917 | 1/1988 | Solow . | |
| 4,754,548 | 7/1988 | Solow . | |
| 4,845,848 | 7/1989 | Strickland . | |
| 4,893,641 | 1/1990 | Strickland | 30/49 |
| 4,916,816 | 4/1990 | Richman . | |
| 4,942,662 | 7/1990 | Radcliffe . | |
| 4,980,974 | 1/1991 | Radcliffe . | |
| 4,993,154 | 2/1991 | Radcliffe . | |
| 5,003,694 | 4/1991 | Chen . | |
| 5,031,316 | 7/1991 | Oldroyd . | |
| 5,084,968 | 2/1992 | Trotta . | |
| 5,161,307 | 11/1992 | Althaus . | |
| 5,199,173 | 4/1993 | Hegemann et al. . | |
| 5,208,982 | 5/1993 | Ferruzza, Jr. | 30/49 |
| 5,220,728 | 6/1993 | Ueno et al. . | |
| 5,287,624 | 2/1994 | Mondo et al. . | |
| 5,333,383 | 8/1994 | Ferraro . | |
| 5,343,622 | 9/1994 | Andrews . | |
| 5,557,851 | 9/1996 | Ortiz . | |
| 5,579,580 | 12/1996 | Althaus et al. . | |

FOREIGN PATENT DOCUMENTS

| | | | |
|---|---|---|---|
| 237152 | 6/1927 | United Kingdom | 30/49 |

*Primary Examiner*—Kenneth E. Peterson
*Attorney, Agent, or Firm*—Harness, Dickey & Pierce, P.L.C.

[57] ABSTRACT

A manually operated, finger and/or hand-manipulatable non-electric body shaving device for shaving substantially curved portions of the body such as the legs, arms and underarm regions, includes a handle portion and a curved razor blade strip base support platform, and a correspondingly curved or curvable razor blade strip platform structure. The razor blade strip platform is longitudinally arranged with respect to the handle or fingergrip portion, and preferably all three major elements, i.e., the handle or fingergrip region, the base support structure and the blade platform structure are located within a common plane for ease of use. Seven different embodiments of my longitudinally arranged body shaving device having one or more substantially curved razor blade strips are shown and described.

26 Claims, 14 Drawing Sheets

FIG-23A
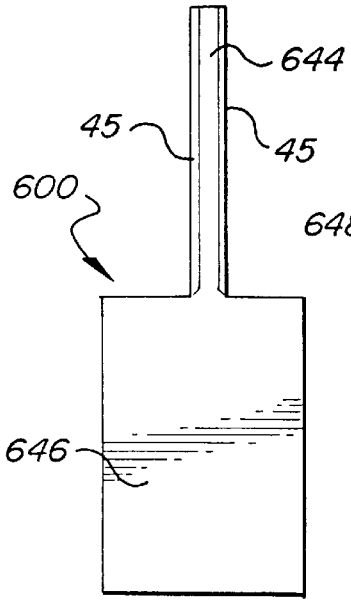
FIG-23B
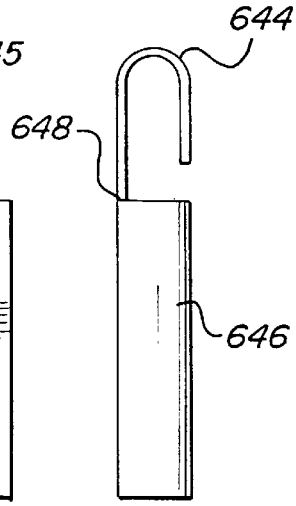
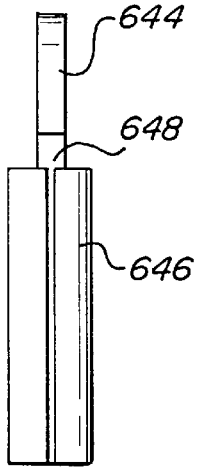
FIG-23C
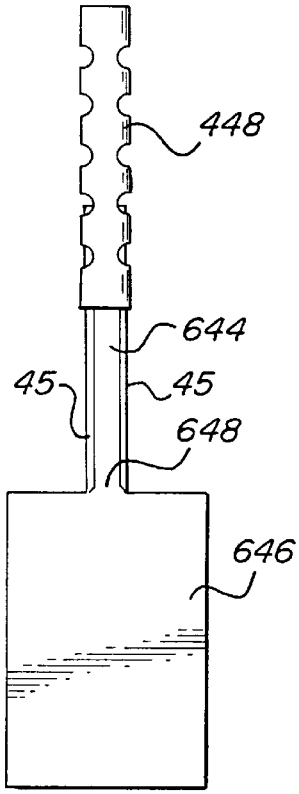
FIG-23D
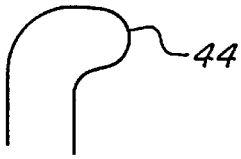
FIG-28
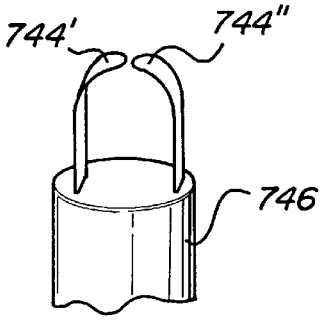
FIG-24
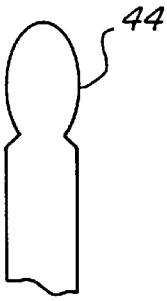
FIG-25
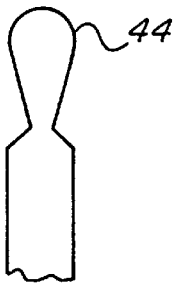
FIG-26
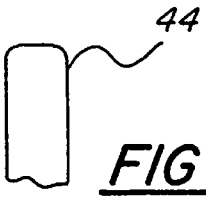
FIG-27

FIG-34
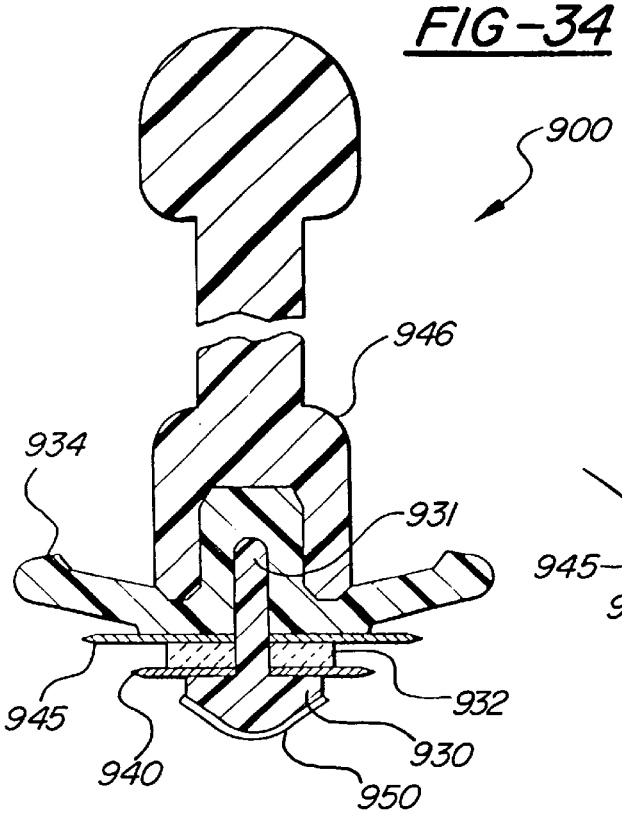
FIG-35
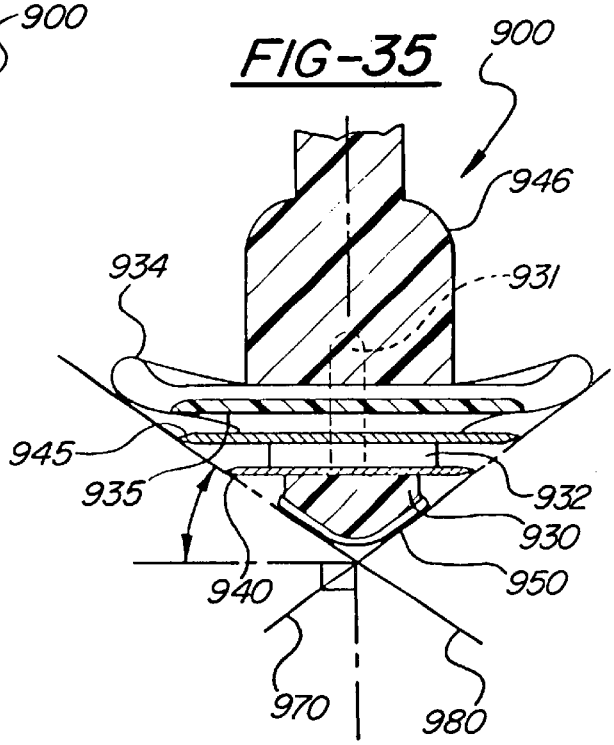
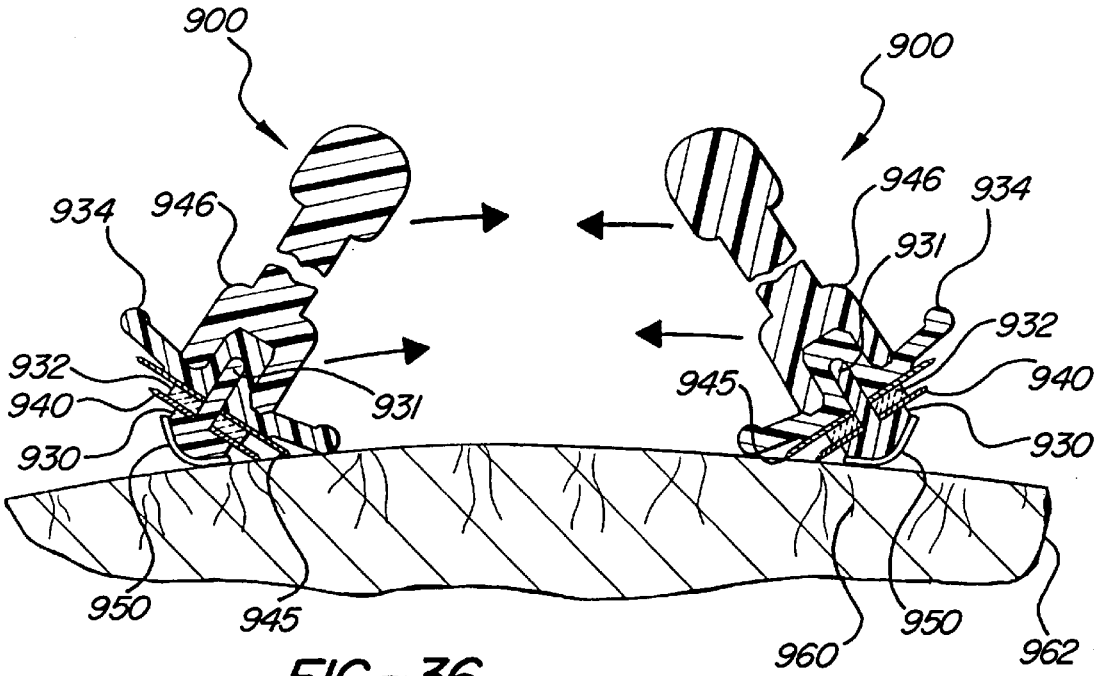
FIG-36

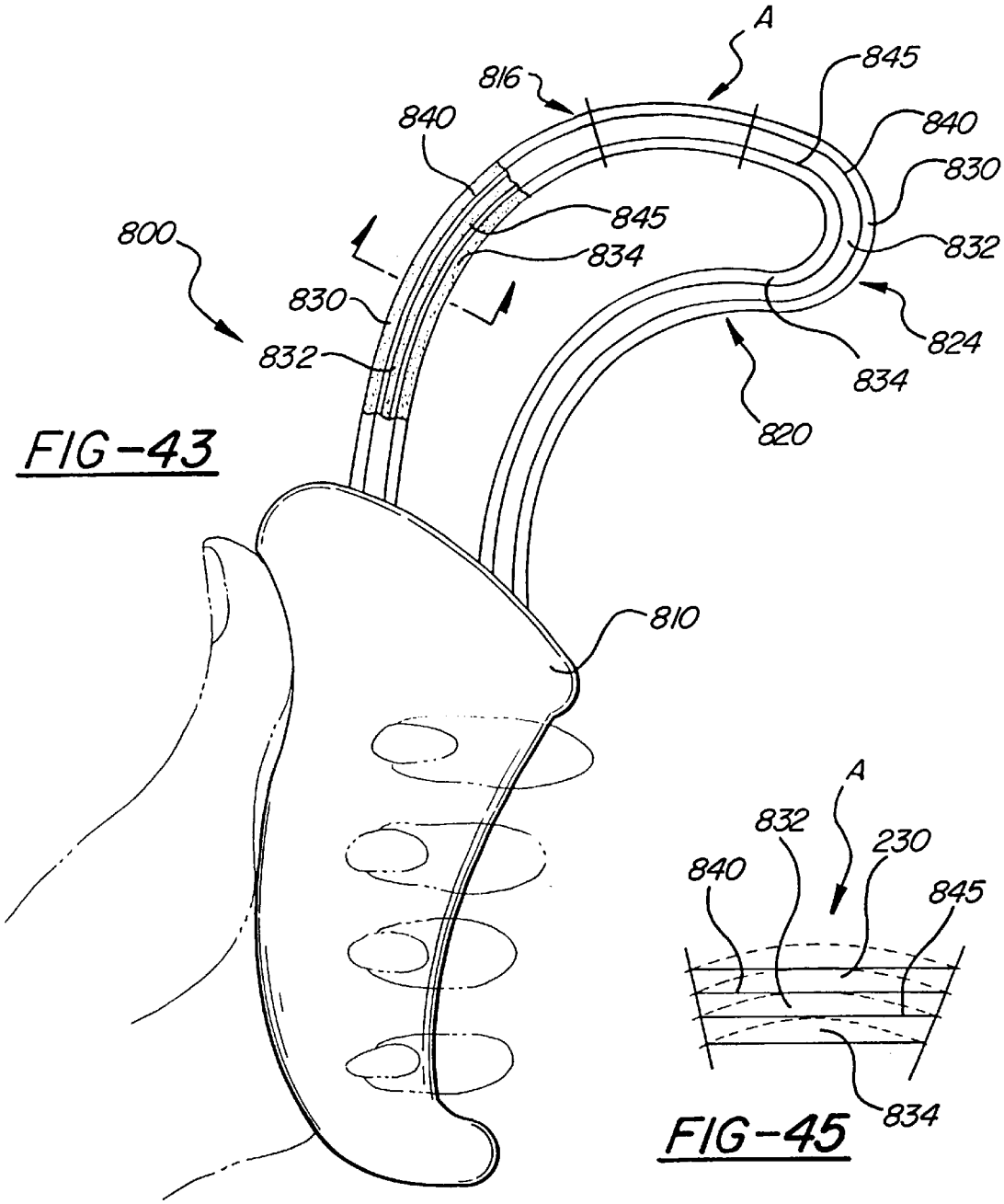
FIG-43
FIG-45
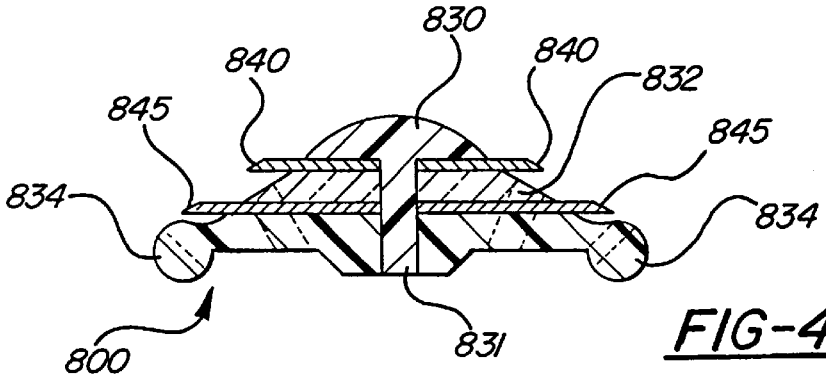
FIG-44

BODY SHAVING DEVICE WITH CURVED RAZOR BLADE STRIP

CROSS-REFERENCE TO RELATED APPLICATIONS

This application is a continuation-in-part of U.S. patent application Ser. No. 08/739,364 filed Oct. 28, 1996 and entitled "Hair Shaving Device With Serrated Razor Blade Strip" (Attorney Docket No. 5391-000008/CPA) which is a continuation-in-part of U.S. patent application Ser. No. 08/473,473 filed Jun. 7, 1995 and entitled "Hair Shaving Device With Curved Razor Blade Strip", which issued on Oct. 29, 1996 as U.S. Pat. No. 5,568,688.

FIELD OF THE INVENTION

This invention relates in general to curved razor blade strip structures for shaving hair and to manually-operated body shaving devices having substantially curved, longitudinally arranged razor blade strip platforms, and in particular to easy to use lightweight manual body hair shaving devices having one or more blade strips with curved razor-sharp cutting edges mounted in association with blade guards and platforms for easy and accurate shaving in two opposite directions. This invention also relates to manual nostril hair trimming devices constructed using one or more flexible razor blade strips which are placed in a preferably U-shaped curved configuration adjacent razor blade strip platforms or guards.

BACKGROUND OF THE INVENTION

It is a common practice to trim the hair extending out of the nostrils or growing in the ears for aesthetic or health reasons. Many devices are used for this task. The devices range from small manicuring scissors or clippers, to specially made cutting devices or machines specifically designed for the task.

There are known devices for trimming nostril or ear hair which utilize a rotary blade to cut the hair. Examples of such devices are described in the following U.S. Pat. No. 4,162,574 to Johnston, No. 2,191,073 to Fishbein et al., No. 2,074,020 to Marholt, and No. 1,973,631 to Johnson. In these devices, a central rotary blade is disposed within a protective guard. The protective guard is provided with a series of slots for receiving hairs to be cut. The rotary blade is rotated manually to cut the hairs which are received in the slots in the protective guard. Other similar devices include a motor for driving the rotary blade within the protective guard. Examples of this type of motorized device are shown in U.S. Pat. No. 5,012,576 to Johannesson and No. 3,731,379 to Williams. The nostril hair trimming devices which utilize a rotary blade suffer from the disadvantages that the rotary blades are complicated and expensive to manufacture. The blades are not designed to be readily replaceable and sharpening the miniature blades is very difficult. If the blades become dull, proper cutting is not obtained, in which case nostril hairs can be pulled or yanked by the dull rotary blade causing discomfort and irritation to the user. In addition, the rotary blade type hair trimming devices can be unsanitary in that they are very difficult to clean. In such devices, the cut hairs are received and cut within the protective guards and there are no means for easily expelling the hairs from the devices after they have been cut.

Other known devices for trimming hair in the nostril utilize miniature clippers which include a stationary cutter member with a plurality of teeth and an adjacent reciprocating cutter member with a plurality of teeth. Hairs which enter the gaps between the teeth of the stationary cutter member are cut off when the adjacent reciprocating cutter member reciprocates past the stationary cutter member and the hairs are sheared. Examples of these known clipper devices are shown in U.S. Pat. No. 2,275,180 to Holsclaw and No. 2,055,129 to Hill et al. The clipper type hair trimming devices suffer from the disadvantage that the cutter members are expensive to manufacture and are difficult to maintain. In addition, the clippers can present the risk of cuts if the clippers are pressed against the skin of a user, since the skin can be pinched or cut by the reciprocating cutter member. Finally, clipper-type trimmers also can yank and pull the nostril hairs especially when the clipper edges become dull.

There are also known razor-type nostril hair trimming devices. Examples of razor-type hair trimming devices are shown in U.S. Pat. No. 1,229,824 to Tewelow, No. 3,574,936 to Bullerman, No. 2,139,680 to Heinrich, and No. 2,089,486 to Kuhn. The devices disclosed in the aforementioned patents to Tewelow and to Bullerman utilize straight razor blades having a guard along the sharpened edges. The straight razor blades are scraped along the inner wall of the nostril in order to shave off the hair. The razor-type hair trimming devices with a straight blade suffer from the disadvantages that they are believed ineffective in easily cutting hairs from the different curved nostril inner surfaces, from which many hairs extend.

The miniature razor trimming device disclosed in U.S. Pat. No. 2,139,680 to Heinrich utilizes a flat blade having a curved sharpened edge. The blade is angularly mounted on the end of a miniature head. A guard is provided for protecting the user from the sharpened edge of the blade. The miniature razor however suffers from the disadvantage that the blades which require a semicircular sharpened edge are difficult to manufacture.

The nasal razor disclosed in U.S. Pat. No. 2,089,486 to Kuhn uses a very short stiff curved steel razor blade positioned between a pair of hinged supports which are mounted to a handle. This nasal trimming device appears to suffer from the disadvantage that its rigid curved blade is useful only when used in a side scraping fashion. The nasal razor is quite small, and by necessity, the miniature blade is also very small, and therefore appears difficult to manufacture and handle. In addition, the blade is not provided with a long straight edge which is desirable for trimming hairs in certain parts of the nostril.

Thus, there has been a continuing need for some simple, inexpensive, lightweight device for enabling an individual to easily trim the nostril hairs without fear of any accidental cuts or scrapes within the nose. Such a hair trimming device for nostril hair should be capable of safely and effectively trimming hair from both curved and straight surfaces.

Further, there is a need for a nostril hair trimming device which has an easily-detached, disposable cutting head or deck, with a substantially permanent reusable handle or fingergrip support structure. There is also a need for a nose hair trimming device that is so small, compact and lightweight that it can fit in a very small size travel toiletry kit or manicuring kit, and can be easily carried around virtually undetected in one's pocket or purse.

The principal object of the present invention is to provide a small, simple-to-operate manual nose hair trimmer with a long curved razor-sharp blade strip which satisfies most if not all of the foregoing needs. An additional object is to also provide such a device which is extremely reliable and safe to use, and which does not require electric power.

A further object is to provide such a nose trimmer with a small grip portion that may be gripped solely in the user's fingertips, for maximum maneuverability. In this way, the user will be able deftly to cut nostril hairs even in the difficult to reach frontal cavity or pocket of each nostril. One more object is to provide an effective cutter head portion which is so small that it can be comfortably inserted into and moved around within a nostril.

One more object is to provide a curved blade hair shaving device which is sufficiently inexpensive so that it may be discarded and replaced frequently. Another object is to provide a nose hair trimming device that does not use a scissors action, and does not have any internal moving parts to break or bind up. One more object is to provide a nostril hair trimming instrument that never pulls or yanks out nostril hairs.

Still another object of the present invention is to provide a cutter portion on a hair shaving device which employs a curved razor blade end-cutting geometry, so that the topmost part of the cutter section of the device can cut hair by a shaving action as well as the side blade strip portion of the cutter section, by using a single sharpened razor blade strip bent into a curved loop configuration.

Another object of the present invention is to use a thin elongated strip of stainless steel provided with a razor-sharp edge that can be mass-produced with ease as the operative tool that is used to shave or cut hair, especially nostril hair. A related important object of the invention is to curve or bend the razor-blade strip into a loop or U-shape to provide the desired end cutting and side-cutting geometry from a single elongated strip of metal alloy having at least one razor sharp edge. A further related object is to provide a cutter head structure that employs a curved elongated razor blade strip within a guard structure that can be easily cleaned to facilitate its reuse.

Yet another object is to provide an easily cleaned curved loop razor blade structure, to facilitate reuse of the curved blade shaving device, which may be a nose hair trimmer, as long as the blade edge remains sufficiently sharp.

Another object is to provide a guarded curved blade shaving device, such as nose hair trimming device, which is inherently easy to operate, so that with a minimum of practice, a user need not even look in a mirror as he uses the device to shave his nostrils or other curved body portions with the device, i.e., those cavities which the end cutting bent loop shape can reach.

Another object of this invention is to provide a razor-sharp nose hair trimmer device which has a manually removable and replaceable, plastic cover which fits over the cutter head for encasing the sharp edge, and is frictionally held in place on the handle, so that it can be stored and transported safely.

SUMMARY OF THE INVENTION

In order to fulfill the most if not all of the needs and objects above-stated, there is provided according to a first few embodiments of the present invention, a manually operated, finger manipulatable non-electric nose hair trimming device, comprising: a head structure sized to fit within a person's nose cavity and arranged to support a flexible razor blade strip having a base portion and a curved guard portion extending from said base portion, said curved guard portion having first and second ends which are attached to said base portion; and a finger grip portion having an end connected to the base portion of said head structure, wherein said head structure includes a thin, elongated narrow razor blade strip formed from a strip of flexible flat razor blade material and bent in a central section thereof to provide a substantially semi-circular section disposed in between first and second substantially straight sections on either side thereof that terminate respectively at first and second ends, said razor blade strip being arranged to extend substantially along the curved guard portion of the head and having a sharpened first edge disposed between the first and second ends, the first and second ends being attached at spaced locations to said base portion of said razor head.

In accordance with another embodiment of the present invention, a manually operated, non-electric nose hair trimming device is provided that has a finger grip portion and a head structure having a base portion in connection with the finger grip portion. The head structure is provided with a hook-shaped blade having first and second ends and at least one razor sharp edge disposed therebetween. The hook-shaped blade is attached to the base portion at the first end, and extends generally perpendicularly away from the base portion and curves around back toward the base portion, but the second end of the hook-shaped blade remains spaced from the base portion.

In accordance with yet another embodiment of the present invention, a hair trimming razor head structure is provided for trimming nose hair or ear hair which includes a very thin elongated razor blade strip with at least one substantially curved razor-sharp edge for shaving hair within a nose or ear cavity, for attachment to a handle of a hair trimming device. The razor head structure includes a base portion with means for connecting the base portion to the handle and a single thin ribbon-like blade strip having two parallel opposed flat surfaces with a first end and a second end and at least one razor sharp edge disposed between the first and second ends. The blade strip is bent to form a curved blade strip that is generally U-shaped and fits within a nose or ear cavity, and which is attached to the base portion at the first end from which the curved blade strip extends away from the base portion and curves around and is attached again to the base portion at the second end of the curved blade strip.

In accordance with still another embodiment of the present invention, a manually operated, finger-manipulatable non-electric hair trimming device is provided for shaving nostril hair, ear hair or the like. The hair trimming device includes a head structure sized to fit within a small body cavity and arranged to support a flexible razor blade strip. The head structure includes a base portion and a curved guard portion extending from the base portion. The curved guard portion has first and second ends which are attached to the base portions. A finger grip portion is provided having an end connected to the base portion of the head structure, for manually manipulating the hair trimming device. The head structure further has a thin, elongated narrow razor blade strip provided with a razor sharp first edge portion, the razor blade strip being bent to extend substantially along the curved guard portion of the head structure such that the sharpened first edge portion defines a curved end cutting edge for trimming hair within a body cavity.

Other objects, features, operating principles, and advantages of the nose hair trimming devices of the present invention will become apparent upon studying the various Figures in the drawings and reading the following detailed description and subjoined claims.

BRIEF DESCRIPTION OF THE DRAWINGS

In the drawings, where the same reference numerals reference like items or features in the different views:

FIGS. 13A through 13E show enlarged views of a series of elongated thin flexible flat metal alloy razor blade strips with one or more razor-sharp edge portions usable in the various embodiments of the present invention wherein:

FIG. 13A is an elongated razor blade strip having a single sharpened edge and a series of centered slots through which the interlock pins of the cage guard extend;

FIG. 13B is a second razor blade strip having end portions which have rectangular apertures to permit preassembly of the blade onto a correspondingly-shaped protrusion of a blade support platform or base structure or a cage guard;

FIG. 13C shows a third razor blade strip having only one side sharpened in three separate places with unsharpened segments therebetween;

FIG. 13D shows a fourth blade strip with a single sharpened edge, to be used in my hair shaving devices to provide end-cutting only; and FIG. 13E is a fourth blade strip having a plurality of notches to permit the blade segments therebetween to be flexed or be twisted.

FIG. 17 is a perspective view of the tenth embodiment with the base portion only partly shown;

FIG. 18 shows a plan view of the sheath before folding overlaid upon a phantom view of the sharpened razor blade;

FIG. 19 shows an end cross-sectional view taken along lines 19—19 of FIG. 17, further showing how the sheath is wrapped around the blade strip; and FIG. 20 is a top cross-sectional view taken along lines 20—20 of FIG. 17, showing two concentric metal rings snapped together which hold the ends of the metal blade and blade edge guard sheath in place.

FIGS. 23A–23D illustrate a twelfth embodiment of the nose hair trimmer of the present invention, including a U-shaped hook blade connected at only one end to the base portion;

FIG. 24 is a perspective view of a thirteenth embodiment of the present invention, which includes a plurality of blade strip portions symmetrically arranged about an oval base support structure; and FIGS. 25–28 show alternative shapes that can be utilized for the bend in the blade strip.

FIGS. 29 through 37 illustrate a first body shaving device of the present invention, which includes a handle, a curved razor blade base support structure, and a curved razor blade platform structure mounted in the base structure and including two spaced-apart razor blade strips which are parallel to one another and follow the curvature of the razor blade support structure, and feature two sets of razor blade edges for bidirectional shaving of legs, arms or like curved body areas, where:

FIG. 29 is a side elevational view of the body shaving device held in a user's hand and shown set down transversely upon a curved body member namely a leg (shown in partial cross-section);

FIG. 30 is a bottom view of the FIG. 29 device showing the contour of the handle and the two sets of opposed blades with a central (speckled) lubricant strip therebetween;

FIG. 31 is a view of a woman using the FIG. 29 body shaver to shave hair from an upper calf portion of her left leg (with the body shaving device shown somewhat larger than its preferred size, for clarity of illustration);

FIGS. 32 and 33 are a side elevational view and a cross-sectional view respectively, of a lightweight plastic storage cover having a generally cylindrical cross-section as best shown in FIG. 33, with a cross-hatched central gripping portion to enable a user to remove the cover from the razor blade strip structure of the body shaving device, which the cover fits over;

FIGS. 34 and 35 are transverse fragmentary cross-sectional views of the FIG. 29 device taken along lines 34—34 and 35—35 respectively of FIG. 29, which help illustrate a preferred internal construction of the base support structure and the razor blade platform structure mounted therein, and the flow-through spaces provided between the parallel razor blade strips at regular intervals, as best seen in FIG. 35;

FIG. 36 illustrates two cross-sectional views of the type shown in FIG. 34 for the purpose of illustrating the shaving action in two directions which can be achieved along a curved area of the body, such as the thigh, which is depicted in longitudinal cross-section;

FIG. 37 is an enlarged fragmentary exploded side elevational view of the curved base support structure and flexible razor blade strip platform structure of the FIG. 29 body shaving device, which shows from bottom to top—the lubricant strip, plastic pins, interconnected flexible cover member, first razor blade strip, five blade spacers, second razor blade strip, and flexible platform member, all of which form the platform structure, which is held by the pin-like projections of the platform structure once inserted into corresponding tapered locking holes in the base support structure.

FIG. 40 shows in phantom two transparent plastic covers for the two blade structures;

FIGS. 43 through 45 illustrate a fifth embodiment of my longitudinally arranged body shaving device, where:

FIG. 43 is a side elevational view of the fifth embodiment, with the device being shown generally in outline form, and illustrating the complex compound curved double-edged razor blade structure thereof, which has a pair of continuous razor blade strips, forming three interconnected regions namely, a gently curving convex region beginning adjacent the handle, a rapidly curving convex region at the distal end of the device, and a concavely curved region opposite the gently curved convex region which terminates at the handle, which device is suitable for shaving virtually all large contoured or curving areas of the human body; and FIG. 44 is an enlarged transverse cross-sectional view taken along lines 44—44 of FIG. 43, which shows the two razor blade strips spaced parallel to one another and held upon a base platform member by a cap member with integral pin, and FIG. 45 illustrates that a curved region may be made to be substantially straight for short distances if desired.

DETAILED DESCRIPTION OF THE PREFERRED EMBODIMENTS

Several different hair trimming devices of the present invention which employ one or more curved razor-sharp blade strips are shown in the Figures and discussed herein. While these embodiments are presently preferred, they are still only exemplary of the various possible curved razor blade strip hair shaving structures and devices of the present invention. As explained further below, I contemplate that, within the scope of the present invention, variants of the curved blade shaving devices of my present invention may readily be constructed based upon my teachings herein.

Figure 1:
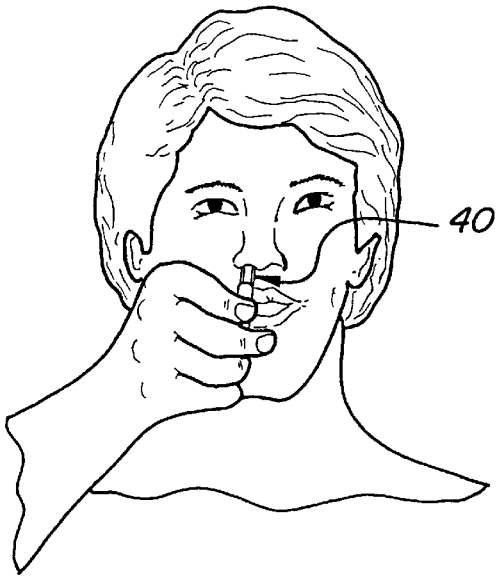
FIGS. 1 and 2 are a front view and an enlarged side perspective view respectively of a man using a first embodiment of the curved blade hair trimming device of the present invention, also shown in FIG. 3, to trim hair within his nose.
Figure 2:
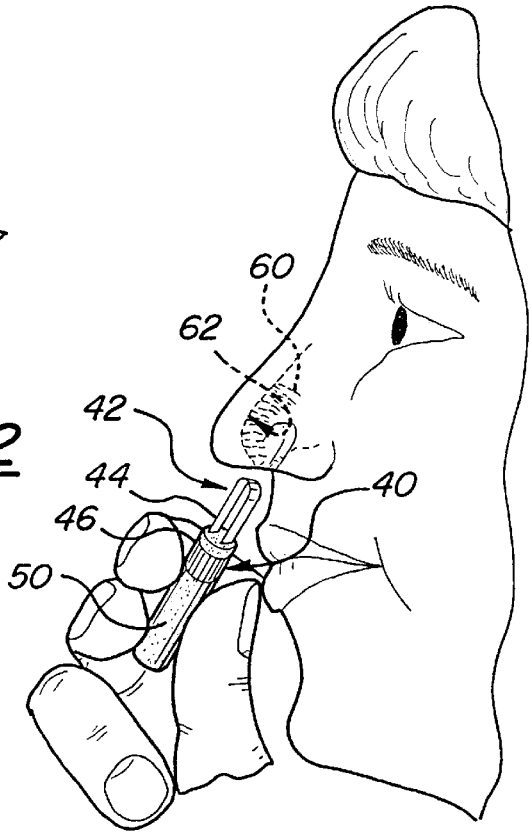

With reference to FIGS. 1 and 2, there are shown a front and a side perspective view of a man using a first embodiment of a basic hair shaving device of the present invention which has a U-shaped razor-sharp blade strip therein, for shaving his nostril hair. In FIG. 1, the nose hair trimming device 40 has a fingergrip sized grip portion, which is hidden by the user's hand. In FIG. 2, a finger-grip sized portion 50 can be seen and is connected to a head structure 42 which includes a curved blade 44 connected to a base portion 46. The nose hair trimming device 40 can be used to safely and effectively trim nostril hair 60 from both curved and straight surfaces within the user's nostril by the use of a straight, generally downwardly-directed shaving stroke. In addition, the curved end-cutting geometry allows the device to be used to cut nostril hairs 60 in the difficult to reach frontal cavity or pocket 62.

The fingergrip portion 50 of the nose hair trimming device may be made of a molded plastic material or of a metal stamping or casting. The body of the device 40 is divided into a head portion 42 and an integrating or grip portion 50. The overall length of the device is relatively small, as for example, on the order of 1.5 to 3.5 inches long with the cutter end or head section being roughly ¾ inches long. In addition, the fingertip grip portion is preferably axially aligned with the head.

Figure 3:
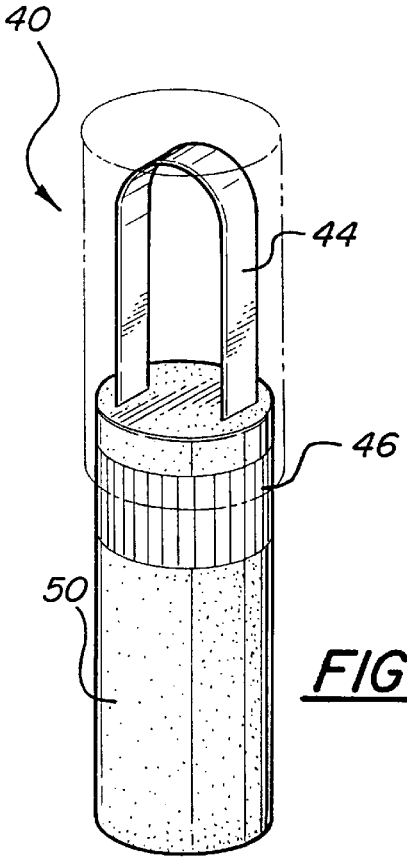
FIG. 3 is a side perspective view of the basic shape of the curved blade razor shaving device of the present invention, with its optional protective guard, and with a clear plastic cover shown in phantom, showing the inverted U-shape of its metal blade strip, having at least one full razor-sharp edge, embedded into the fingergrip base.

With reference to FIG. 3, a perspective view is shown of a basic trimmer 40 of the present invention without a protective guard. The basic geometry of the hair trimming device 40 includes a U-shaped metal blade strip 44 embedded into a base 46. The blade strip 44 is ribbon-like and is provided with two parallel opposed flat surfaces and a razor sharp edge. A cap member 47 is shown in phantom for covering the blade strip 44 when not in use.

Figure 4:
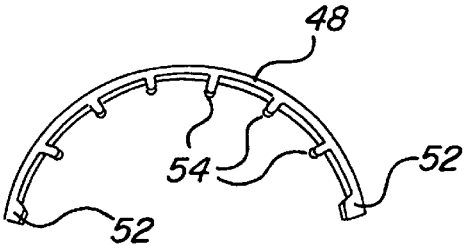
FIG. 4 is a perspective view of a first embodiment of the protective blade guard cage having multiple overhanging guard fingers, that is usable with the FIG. 3 embodiment.

FIG. 4 is a perspective view of a protective blade guard 48 usable with the device of FIG. 3. The protective blade guard 48 is provided with two end portions 52 for connecting the protective blade guard to the metal blade strip 44 or the base portion 46. The protective guard 48 is also provided with a plurality of teeth or fingers 54, spaced apart as shown, which are designed to overhang portions of the sharpened edges on either side of the elongated blade strip 44. Depending upon the width and number of and spacing between the fingers 54, anywhere from about 20 percent to about 80 percent of the blade edge may be exposed through the spaces between the fingers 54, with 35 to 70 percent exposure being preferred. The fingers extend sufficiently beyond the sharpened edge of the adjacent blade, by about 0.5 mm to about 2 mm or more, depending upon the finger spacing, so that it is essentially impossible for the skin of the user to make a contact with the sharpened blade edge, even when above average side pressure is applied by the user to the cutter end of the device. In particular, when the spacing of the fingers 54 is sufficiently close, such as on the order of about 1 mm to about 2 mm, this result is easily accomplished. The width of the individual fingers 54 is preferably on the order of about 1 mm to about 4 mm, with 2 to 3 mm being presently preferred. The outer surfaces of the fingers 54 that do or potentially can come into contact with the user's skin are preferably gently rounded as shown to reduce the possibility of inadvertently scratching the user's skin. Such scratches might otherwise occur with sharp edges on the fingers as a user draws the fingers gently across his skin within his nostrils (or elsewhere) as he executes a generally linear and downwardly directed or laterally directed shaving stroke across the skin from which the nostril hairs to be trimmed protrude.

Figure 5:
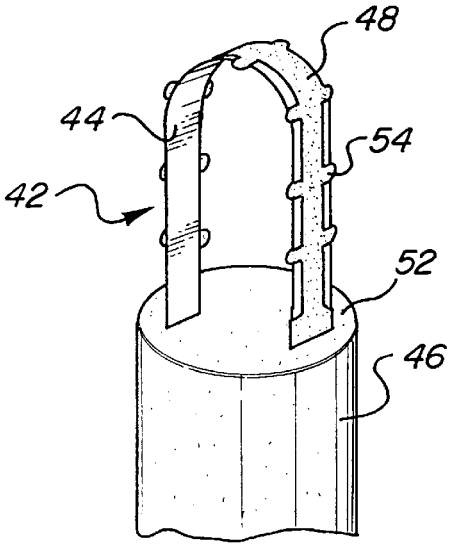
FIG. 5 is a perspective view of a second embodiment of the curved blade hair shaving device of the present invention, showing the FIG. 4 protective blade guard in place over the metal blade strip of the FIG. 3 device, and revealing how the fingers partially envelop the edge of the blade strip.

FIG. 5 is a perspective view showing a second embodiment of the present invention with the protective blade guard 48 in place over the metal blade strip 44 of the device shown in FIG. 3. The protective guard 48 can be secured to the metal blade strip 44 by any means including glue.

Figure 6A:
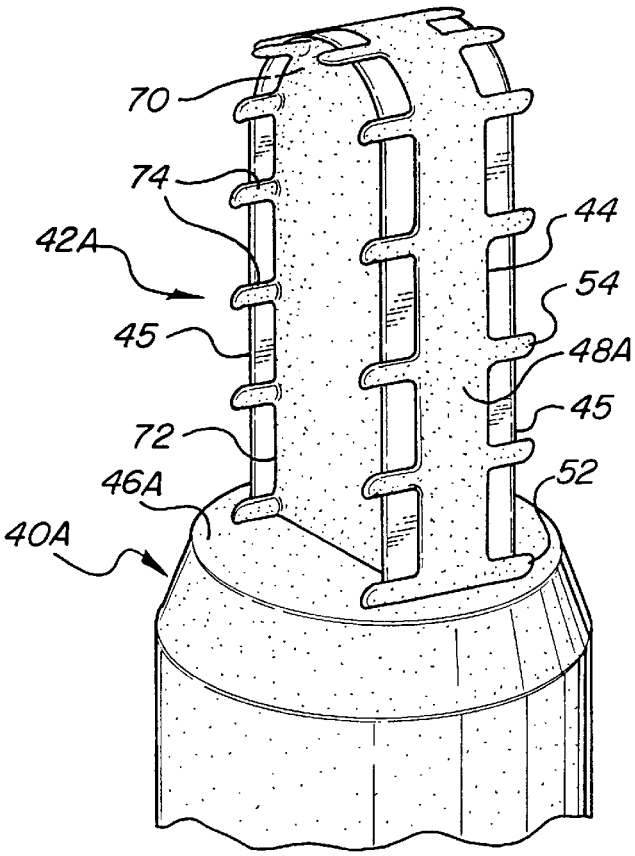
FIG. 6A is a perspective view of a cutter end portion of a third embodiment of the curved blade hair shaving device of the present invention, showing an elongated double-edged razor blade strip, an (inverted) U-shaped solid blade support platform inside the blade strip, and a multiple finger guard cage interlocked by pins (not shown), the blade strip extending through and into the support platform overlaying the sharpened blade edges for protecting the user's skin against blade nicks.

FIG. 6A is a perspective view of a third embodiment of the head structure 42A of the nose hair trimming device 40A of the present invention. In FIG. 6A there is shown a generally solid blade support platform 70 having a horseshoe-shaped perimeter which is attached to a base portion 46A of the head structure 42. A double-edged blade strip 44 is wrapped around the horseshoe-shaped blade support platform 70 such that each of the razor sharpened edges 45 of the double-edged blade strip 44 extend beyond outer edges of a blade seat portion 72 of the horseshoe-shaped blade support platform 70. A multiple finger guard cage 48 overlays the blade edges 45 for protecting against blade nicks. The multiple finger guard cage 48A secures the blade in its position along the blade seat portion 72 by means which will be described in greater detail hereinafter. The blade seat portion 72 of the blade support platform 70 is provided with a plurality of extending fingers 74 which correspond with the fingers 54 of the cage guard 48.

Figure 6B:
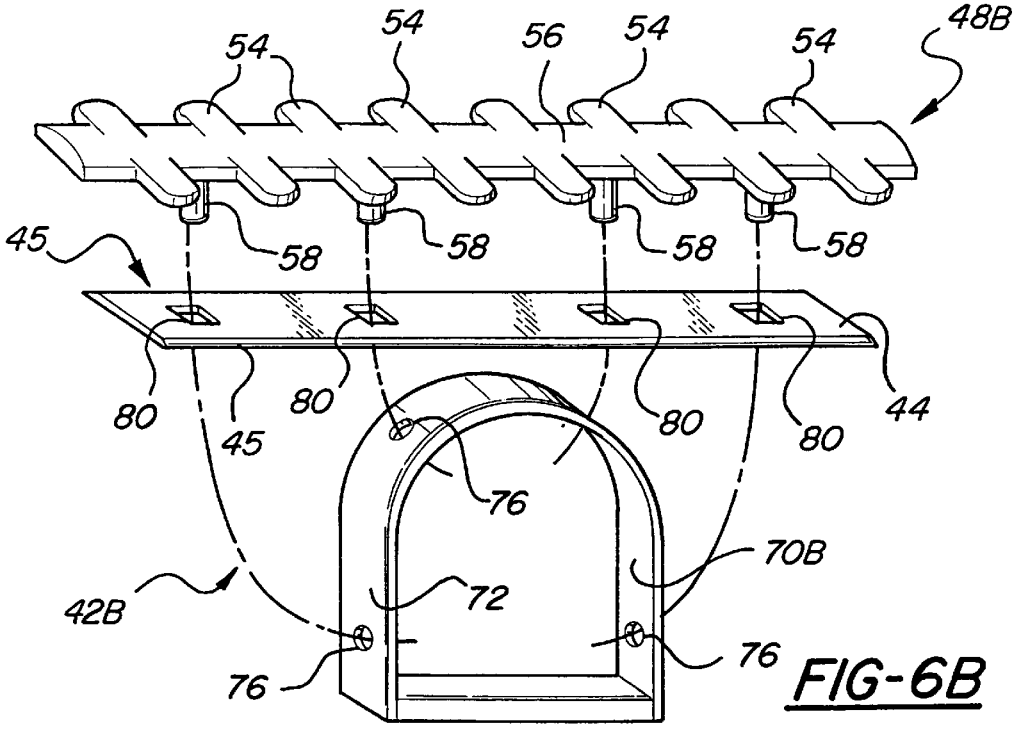
FIG. 6B is an exploded perspective view of the components of the cutter end portion of the fourth embodiment which is like the third embodiment of FIG. 6A, except the blade support platform (which is a hollow second version) of a nose hair trimming device of the present invention.

FIG. 6B is a perspective view of a fourth embodiment 42B of the present invention illustrating the assembly of the head structure 42B a nose hair trimming device 40. In particular, a hollow horseshoe-shaped blade support platform 70B is provided having a plurality of pin receiving holes 76 disposed in the periphery of the horseshoe-shaped blade support platform 70B. A double-edged blade strip 44 is shown having a plurality of pin receiving holes 80 which correspond to the locations of the pin receiving holes 76 of the horseshoe-shaped blade support platform 70. The double-edged blade strip 44 is wrapped around the periphery of the blade seat portion 72 of the blade support platform 70. A multiple finger guard cage 48B is provided having an elongated central portion 56 with a plurality of protective fingers 54 extending laterally therefrom. In addition, a plurality of pins 58 extend from a bottom of the elongated central portion 56 thereof. In order to assemble the head structure 42 of the nose hair trimming device 40, the pins 58 of the multiple finger guard cage 48B are inserted through the pin receiving holes 80 in the double-edged blade strip 44 and both the multiple finger guard cage 48B and the double-edged blade strip 44 are wrapped around the periphery of the blade seat portion 72 of the blade support platform 70. The pins 58 are then inserted into the holes 76 provided in the periphery of the blade seat 72 in order to secure the blade strip 44 and the guard cage 48 to the blade support platform 70.

Figure 7A:
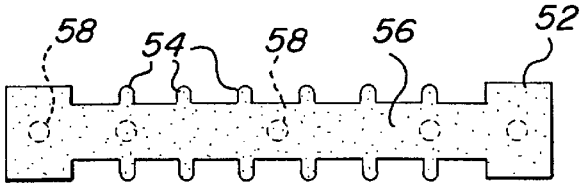
FIGS. 7A and 7B are top and side elevational views, respectively, of an alternate version of the guard cage usable within the two versions of the embodiments shown in FIGS. 6A and 6B, which guard cage has overhanging fingers that will partially envelop the edges of the blade strip.
Figure 7B:
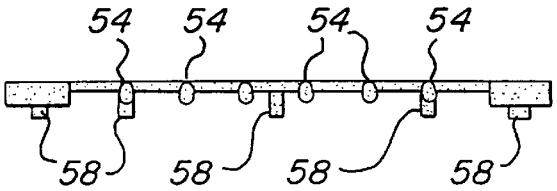

With reference to FIGS. 7A and 7B, the multiple finger guard cage 48B used in the fourth embodiment will be described in detail. The multiple finger guard cage 48B includes a central elongated strip 56 having two end connecting portions 52. A plurality of laterally extending fingers 54 extend from the first and second edges of the elongated central portion 56. As best seen in FIG. 7B, the lateral extending fingers 54 may be arranged to extend beyond a lower surface of the elongated central portion 56. A plurality of pins 58 are also provided which extend from the lower surface of the end connecting portions 52 and at intervals along the elongated central portion 56. The number of pins 58 can be varied according to specific design choices.

Figure 8:
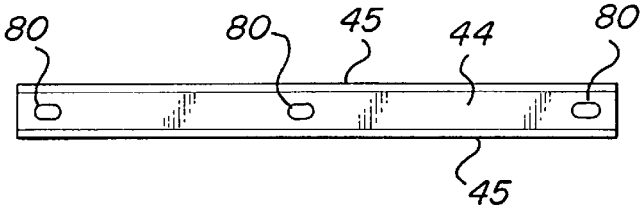
FIG. 8 is a plan view of a representative elongated thin blade strip for the fourth embodiment (FIG. 6) shown laid out in planar form, which reveals the opposed razor-sharp blade edges and a series of apertures through which the locking pins of the guard cage protrude.

With respect to FIG. 8, a double-edged blade strip 44 according to the fourth embodiment is shown in planar form. The blade strip 44 is provided with two razor-sharpened edges 45 and a plurality of elongated apertures 80 through which pins of the guard cage are inserted.

Figure 9:
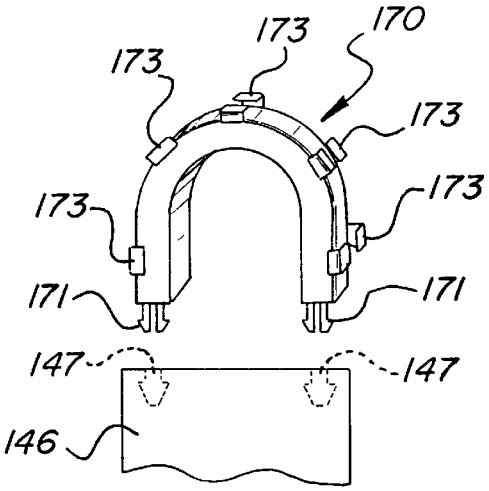
FIG. 9 is a side perspective view of a fifth embodiment of the present invention, which employs a third version of a U-shaped blade support platform, which has protruding side ears that are used in place of the guard cage shown in the second embodiment, and which also has nape-prongs at the lower free ends of the support platform that couple into corresponding apertures in the base portion.

FIG. 9 is a side view of a fifth embodiment of the nose hair trimmer of the present invention which employs a horseshoe-shaped blade support platform 170. The blade support platform 170 is provided with nape-prongs 171 at the lower ends of the blade support platform 170 which couple into and interlock with corresponding apertures 147 in the base portion 146. The blade support platform 170 is provided with protruding side ears 173 which take the place of the guard cage shown in the fourth embodiment. The protruding side ears 173 extend beyond the outer edges of a blade strip, not shown, and wrap around the outer edges of the blade strip in order to secure the blade strip to the blade support platform 170. As noted above, the protruding side ears 173 provide a guard for protecting against blade nicks.

Figure 10:
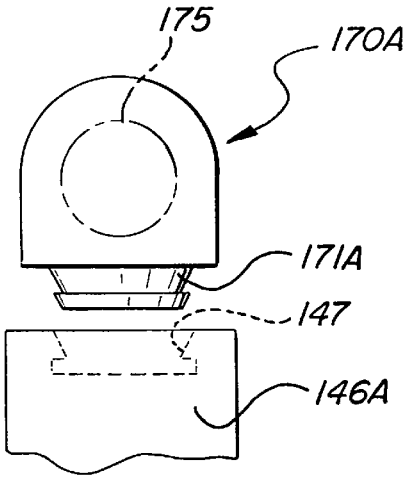
FIG. 10 is a side elevational view of a sixth embodiment of the present invention, which employs a fourth version of a U-shaped blade support platform with an oblong lower post with a lower protruding lip that snaps into a single corresponding internal hole with lower internal groove in the fingertip base.

With respect to FIG. 10, a sixth embodiment of the present invention is shown with a second version 170A of the blade support platform 170 having a single prong 171A for insertion into and interlocking with a corresponding internal hole 147 of the fingergrip base 146A is shown. The blade support platform 170A may be provided with a centrally disposed hole 175 as shown in phantom lines.

Figure 11:
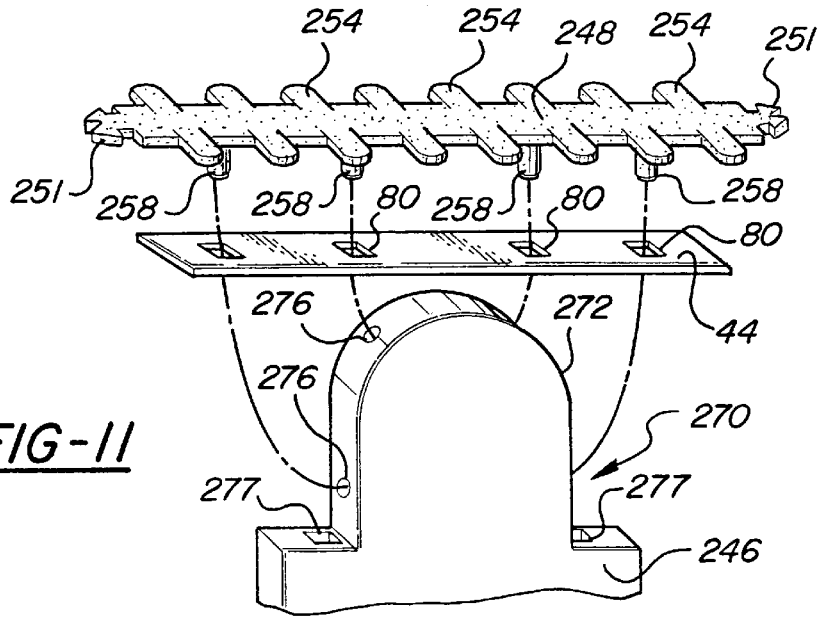
FIG. 11 is a side elevational view of a seventh embodiment, which employs a fifth version of my U-shaped blade support platform made from plastic material with an integral fingergrip base, showing the curved blade strip and cage guard ready to snap into registration holes in the integral platform and base.

As shown in FIG. 11, a seventh embodiment of the present invention is shown with a third version 270 of a blade support platform 270. The blade support platform 270 is provided with a base portion 246 and a U-shaped blade seat portion 272 integrally formed. The U-shaped blade seat portion 272 is provided with a plurality of holes 276 at various intervals around the periphery of the blade seat portion 272. A pair of receiving holes 277 are also provided in the base portion 246 adjacent to each side of the blade seat portion 272. A blade strip 44 and a multiple finger guard cage 248 are provided for being assembled onto the blade support platform 270. The guard cage 248 is provided with a plurality of pins 258 which are inserted in corresponding pin holes 80 in the blade strip 44 and also inserted into the pin holes 276 of the blade support platform 270. The multiple finger blade guard 248 is also provided with nape-prongs 251 on each end thereof which are inserted into and interlock with the holes 277 in the base portion 246 of the blade support platform 270.

Figure 12:
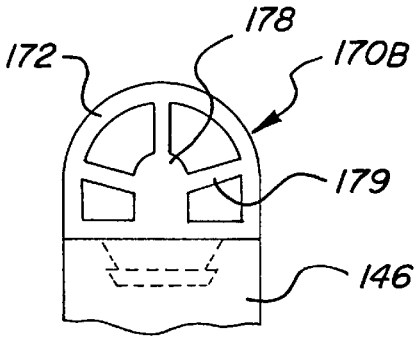
FIG. 12 shows an eighth embodiment having a sixth version of my U-shaped blade support platform which is substantially open and has supporting ribs connected to a central post.

With respect to FIG. 12, an eighth embodiment of the present invention with fourth version 170B of the blade support platform 170B is shown. The blade support platform 170 is provided with a blade seat portion 172 and a centrally disposed portion 178. A plurality of supporting ribs 179 extend from the centrally disposed portion 178 to the blade seat portion 172.

Figure 13A:
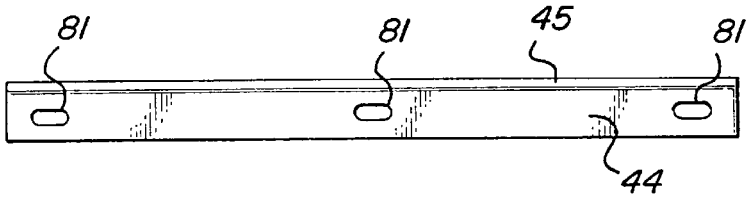

FIGS. 13A–13E show a series of razor-blade strips usable in the various embodiments of the present invention. FIG. 13A shows an elongated razor blade strip 44 having a single sharpened edge 45. The razor blade strip 44 is provided with a series of centered slots 81 through which pins of the blade guard extend.

Figure 13B:
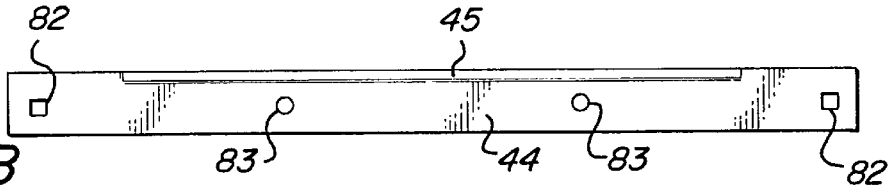

FIG. 13B is a similar razor blade strip 44 having a single sharpened edge 45 which extends only partially along the length of the blade strip 44. A pair of rectangular apertures 82 are provided in each end of the blade strip and a pair of centrally disposed pin holes 83 are provided to permit preassembly of the blade onto a base structure.

Figure 13C:
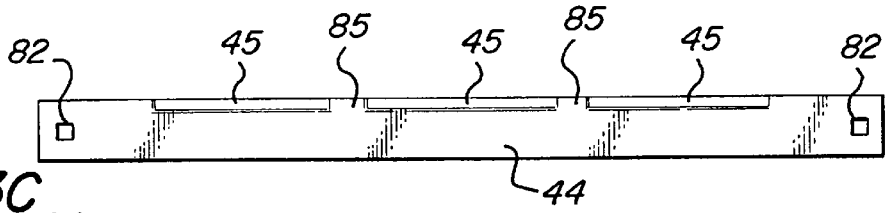

FIG. 13C shows a third razor blade strip having three sharpened edge segments 45 in separate places along one side with unsharpened edge segments 85 therebetween. The unsharpened segments 85 are designed to correspond to the location of the fingers 54 of the guard cage 48. In this way, the fingers 54 of the cage 48 will not be cut by the sharpened edges 45 of the blade strip 44.

Figure 13D:
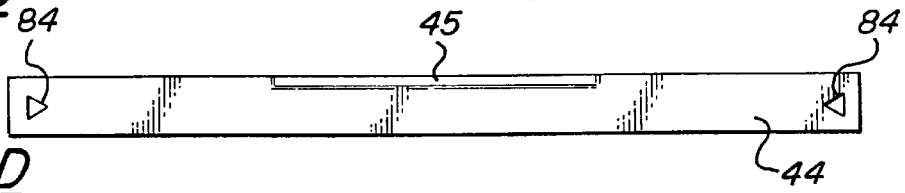

FIG. 13D shows an elongated blade strip 44 with a single sharpened edge 45 which is provided in the central portion of the blade strip 44. The location of the sharpened edge 45 in the central portion provides a nose hair trimming device with end-cutting capability only. A pair of triangular apertures 84 are provided in the ends of the blade strip 44.

Figure 13E:
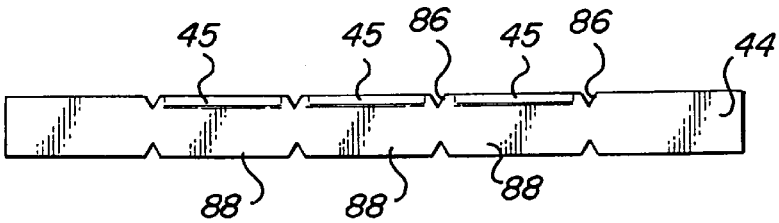

FIG. 13E is an elongated razor blade strip 44 having a plurality of notches 86 to permit the blade segments 88 to flex or be twisted. Twisting of the blade segments 88 may be desirable in order to angle the sharpened edge 45 of the blade in order to improve the cutting angle. The blade seat portion of the blade support platform may also be angled in order to support the notched blade segments 88 in the twisted or angled position.

Figure 14A:
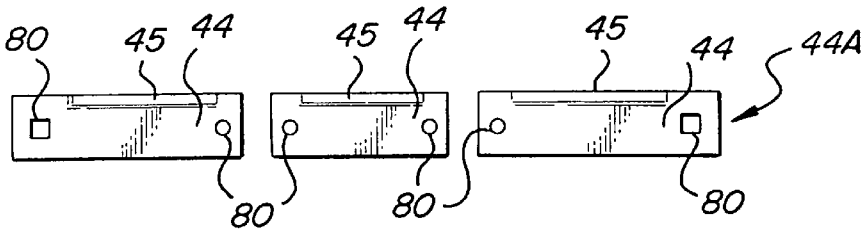
FIG. 14A shows a long segmented razor blade strip structure laid flat consisting of three separate elongated thin flexible blade strips, each having a long razor sharp edge portion and a plurality of pin locating apertures.

FIG. 14A shows a segmented razor blade structure 44A consisting of three separate blade strips 44. Each separate blade strip has a sharpened edge portion 45 and a pair of pin locating apertures 80.

Figure 14B:
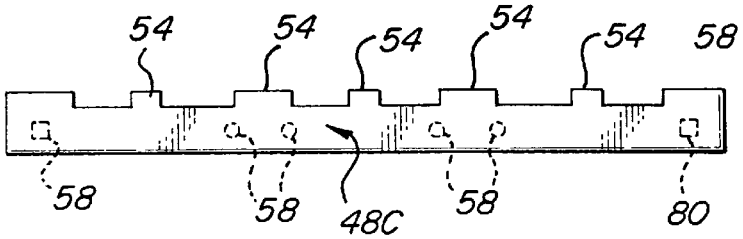
FIGS. 14B and 14C are top and side views of a single-sided semiflexible cage guard structure shown laid flat, which is designed for use with the FIG. 14A segmented razor blade strip structure, with the FIG. 14C view being taken along lines 14C—14C of FIG. 14B and showing the seven overhanging finger segments and the six interlocking pins of the cage guard structure.
Figure 14C:
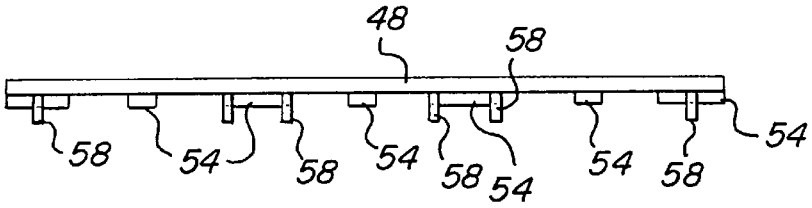

FIG. 14B is a top view of a single-sided guard structure 48C designed for use with the segmented blade structure 44A. The guard structure includes a plurality of finger segments 54, some of which correspond to the engagement locations of the separate blade strips 44 shown in FIG. 14A. A plurality of pins 58 are best shown in FIG. 14C on the bottom surface of the guard structure 48. The pins 58 are inserted into the pin locating apertures 80 of the separate blade strips 44 in order to mount the blade strips to the blade support platform.

Figure 15:
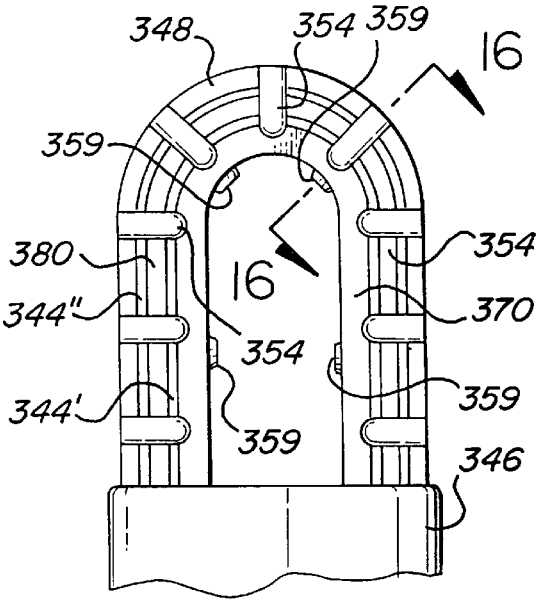
FIG. 15 is a side elevational view of the cutter end portion of a ninth embodiment of the curved blade hair shaving device of the present invention which had two elongated razor blade strips arranged in an evenly spaced relation to one another about a U-shaped blade deck support structure.
Figure 16:
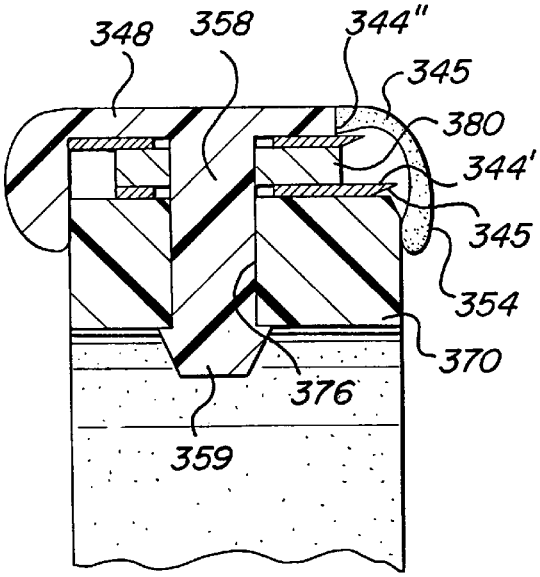
FIG. 16 is an enlarged cross-sectional view, taken along line 16—16 of FIG. 15, showing the spaced arrangement of the two blade strips and an interlocking pin of the cage guard structure passing through the blade strips and blade deck.
Figure 17:
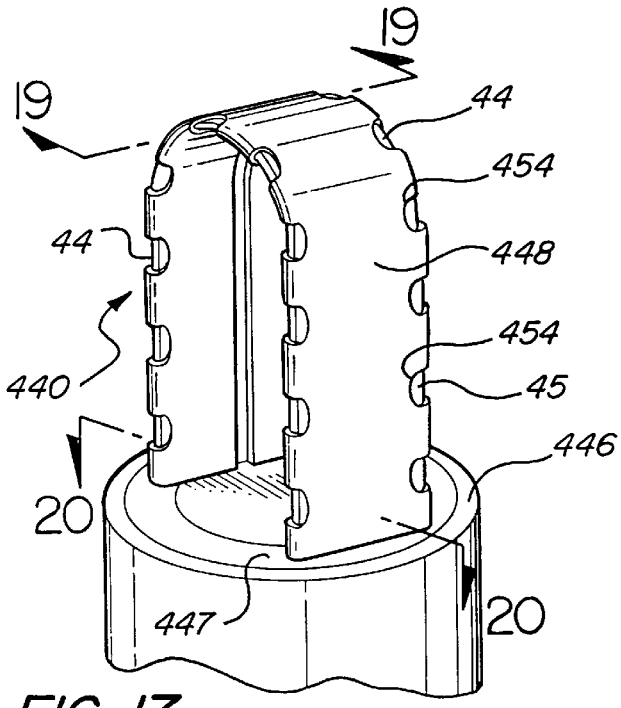
FIGS. 17 through 20 show a tenth embodiment of the nose hair trimmer of the present invention which has a substantially rigid to semi-flexible stainless steel blade strip having two razor sharp edges surrounded by a thin folded metal sheath having a plurality of apertures therein to expose the portions of the sharpened blade edges, where.

FIG. 15 shows, a side view of the cutter end portion of a nose hair trimmer 340 according to a ninth embodiment of the present invention is shown having two blade strips 344', 344". FIG. 16 shows a cross-sectional view taken along lines 16—16 of FIG. 15 illustrating the double blades 344', 344". In FIGS. 15 and 16, a blade support platform 370 is provided with a plurality of apertures 376 disposed therein. A first blade strip 344' is wrapped around the outer periphery of platform 370. A spacer member 380 is then wrapped around the first blade 344' and a second blade 344" is then wrapped around the spacer member 380. The first and second blades 344', 344" and the spacer member 380 are each provided with apertures, not numbered, which receive a pin 358 which extends from a guard cage 348 which is wrapped around the double blade structure. The guard cage 348 is provided with a plurality of fingers 354 which protect a user's skin from contacting the sharpened edges 345 of the first and second blade strips 344', 344". The pins 358 which are provided on the guard cage 348 have a tapered head portion 359 which is extended through the apertures in the first and second blade members 344', 344", the spacer member 380 and the blade support platform 370 in order to interlockingly secure the blade guard cage 348 in place.

Figure 18:
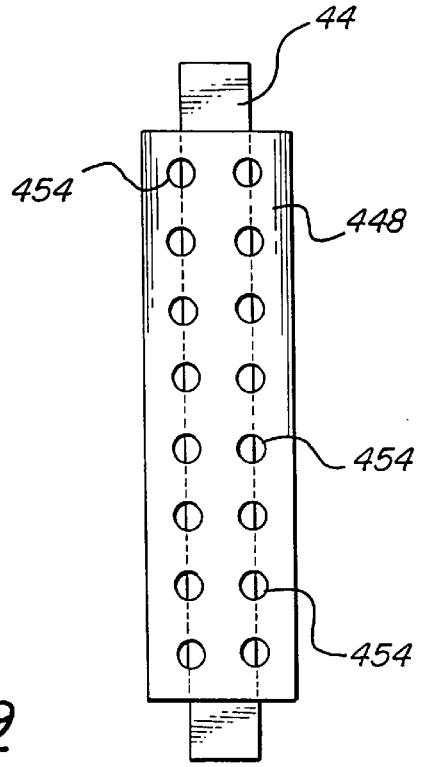
Figure 19:
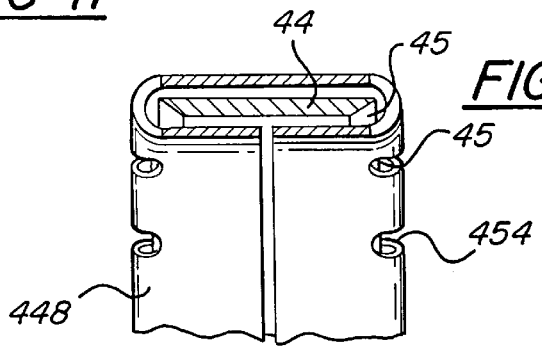
Figure 20:
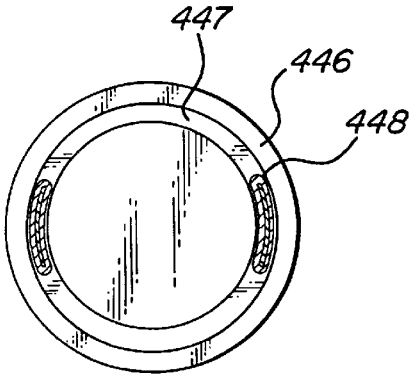

FIGS. 17–20 show a tenth embodiment of the nose hair trimmer 440 of the present invention. According to this embodiment, a double-edged blade strip 44 is provided within a stainless steel blade housing 448. The housing 448 is provided with a plurality of apertures 454 which expose the sharpened blade edge 45, while guarding the user's skin against nicks. The housing 448 is formed by providing a flat strip 448 with a plurality of apertures 454, as shown in FIG. 18. The flat strip 448 is then wrapped around the blade strip 44 to form a sleeve-like guard as shown in cross-section in FIG. 19. The blade housing 448 may be secured to the base portion by any means. FIG. 20 shows two concentric metal rings 446, 447 snapped together which hold the metal blade 44 and blade housing 448 in place. The blade housing 448 may be welded to the ring 447 or held in place by other known means.

Figure 21:
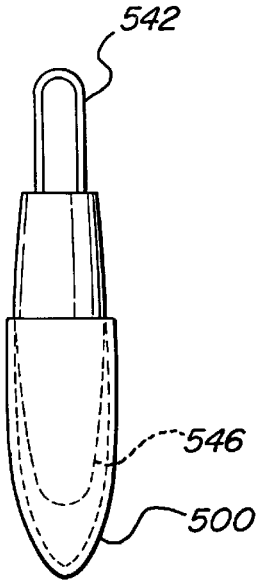
FIG. 21 shows an eleventh embodiment of the present invention, which includes a fingergrip-sized base connected to the nose hair trimming end portion, with a plastic cap disposed over the base and ready to be placed over a cutter end when not in use.
Figure 22:
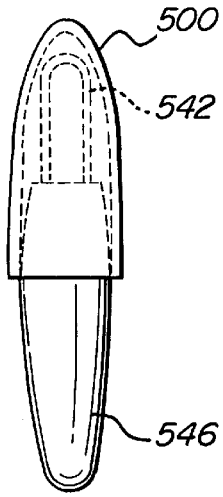
FIG. 22 shows the FIG. 21 device with cap in place covering the cutter end.

With respect to FIG. 21, an eleventh embodiment of the present invention is shown which includes a fingertip-sized base 546 connected to the nose hair trimming head structure 542. A plastic cap 500 is also provided which can be in serted on either end of the fingertip-sized base 546. When the plastic cap 500 is placed over the fingertip-sized base 546 as shown in FIG. 21, the plastic cap 500 can also be used as a handle portion. The U-shaped nose hair trimming head structure 542 can be any of the above-described types. In FIGS. 21 and 22, the U-shaped nose hair trimming portion is merely drawn schematically. With the plastic cap 500 covering the head structure 542, as shown in FIG. 22, the device can be easily carried in a user's poket, purse or cosmetic case.

With respect to FIGS. 23A–23D, a twelfth embodiment of the nose hair trimmer of the present invention is shown. In FIG. 23A, a flat piece of metal 600 is shown having a base portion 646 and an elongated strip 644 having two sharpened edges 45. The base portion 646 is rolled in order to form a handle portion as shown in FIGS. 23B and 23C. The blade portion 644 is then bent to form a U-shaped hook blade connected at only one end 648 to the base portion. In FIG. 23D, a stainless steel blade housing or sleeve 448 is shown being slid over the blade portion 644. The stainless steel blade housing 448 is similar to that disclosed in FIGS. 17–19. It is also noted that as an alternative to the embodiment shown in FIGS. 23A–23D), the blade housing may be integrally formed with the base portion of a single sheet of metal instead of the blade member. In this way, a separate blade strip can then be inserted into the blade housing which is integrally formed with the base portion. In either embodiment, the blade strip and the blade housing can be welded, soldered, glued, or held to one another by any other known means.

With respect of FIG. 24, an alternative blade construction is schematically shown wherein the cutting blade includes two separate blades 744', 744" each embedded in an oval cross-section base support structure 746. Each blade strip 744', 744" is curved toward one another at their end portions to form a substantially U-shaped cutting surface with an opening therebetween. A guard structure of any of the types disclosed above can be used in conjunction with this blade structure.

With respect to FIGS. 25–28, alternative shapes for the curvature of the blade strip are shown. One of ordinary skill would of course recognize that the blade strip can be bent in or otherwise performed into many shapes without departing from the scope of the present invention.

Figure 29:
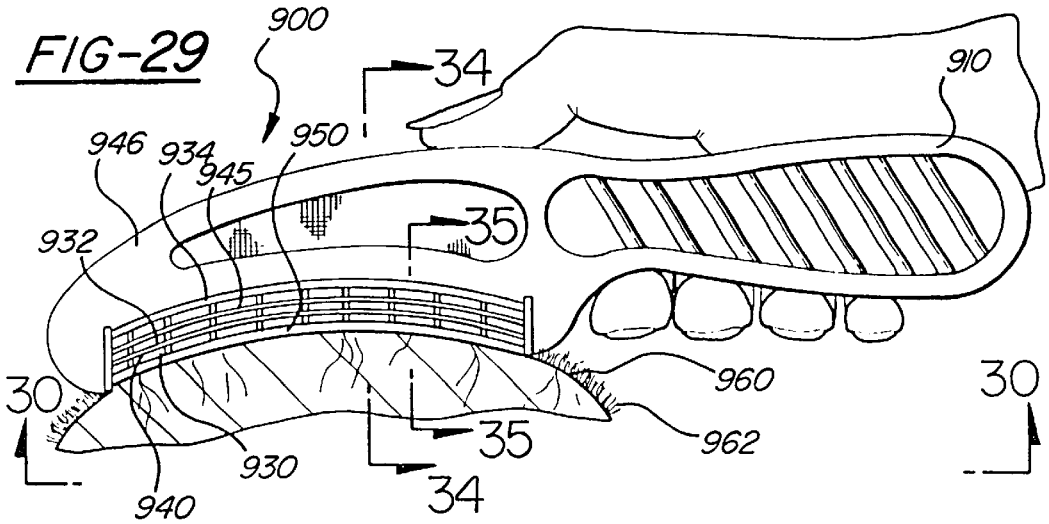
Figure 30:
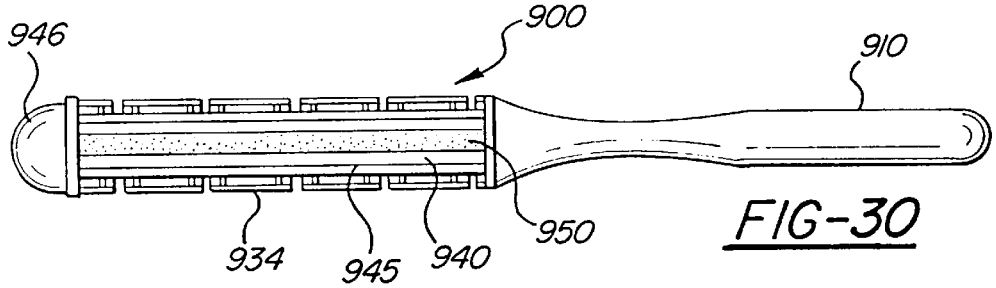

FIGS. 29–37 show another embodiment of a curved hair razor blade device 900 of the present invention. Specifically, FIGS. 29 and 30 show a side view and a bottom view, respectively, of a curved hair razor blade device 900, including a handle portion 910, a curved shaving portion or razor blade head 920, and a base support structure 946. Shaving portion 920 and base support structure 946 are symmetrically arranged as shown in line along a common central longitudinal axis and plane. The curved shaving portion or head 920 of device 900 is disposed toward the front of device 900 along the generally concave side, and is supported by base support structure 946. As can be seen in FIG. 29, handle portion 910 and base support structure 946 are preferably formed as a single, continuous piece of material, which may be plastic (as shown by the cross-hatching in FIGS. 34 and 35).

Figure 37:
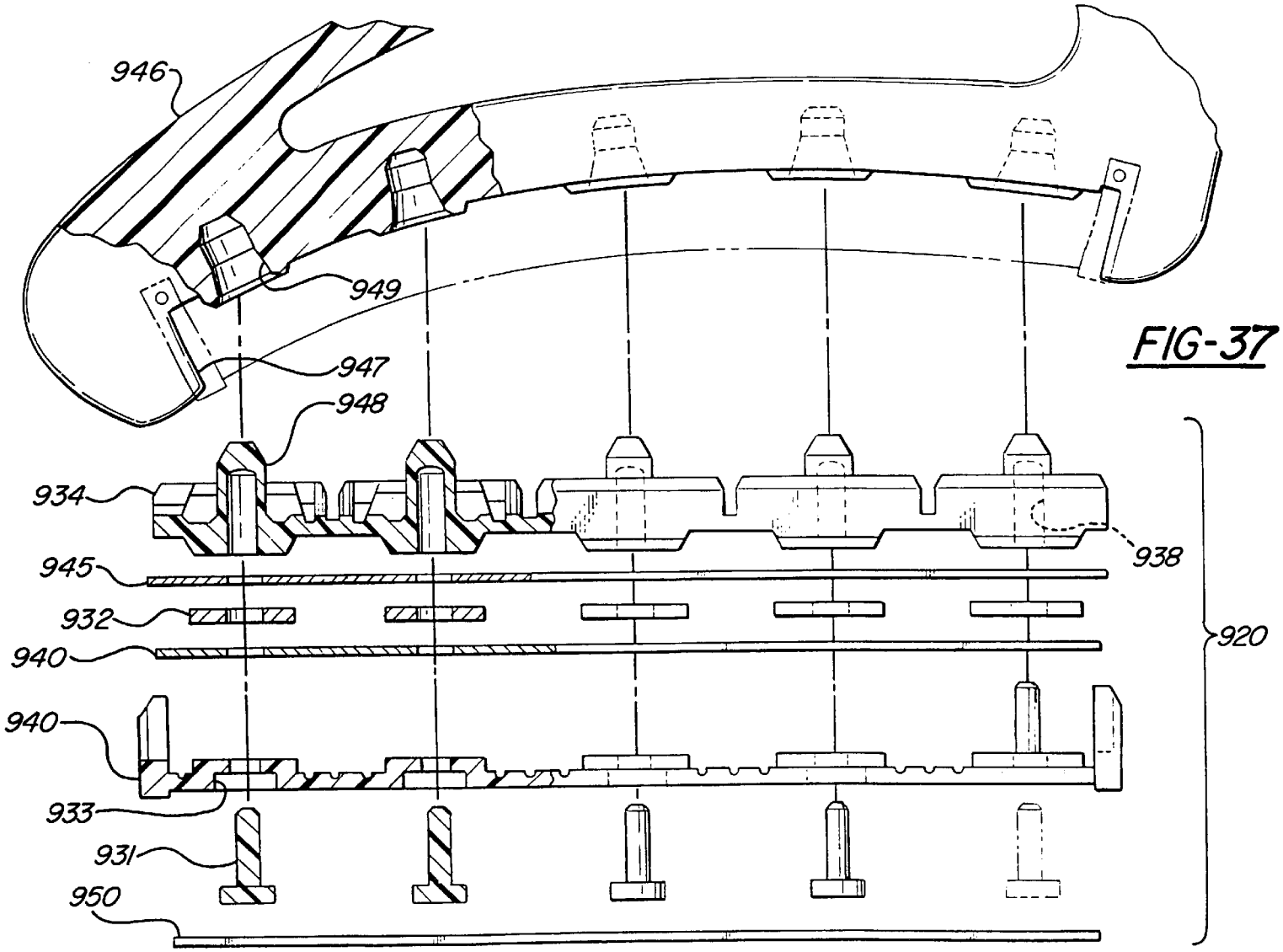

As best shown in FIGS. 29, 30 and 34–37, curved hair razor blade device 900 preferably includes a curved razor blade structure 920 built upon a flexible platform 934 and includes two closely spaced razor blade strips 940 and 945 that, even though curved in use, are kept parallel to one another and follow the corresponding curvature of razor blade support structure 946 in which the razor blade platform structure 934 of curved shaving head 920 is mounted. As can best be understood by viewing FIGS. 29 and 37 together, the razor blade head structure 920 is generally flexible and is constructed from flexible materials, including one or more thin, flexible razor blade strip members 940 and 945. As such, the razor blade head structure 920, before assembly, has a flat geometry, as shown in FIG. 37, and is subsequently bent upon assembly into a curved configuration to match the particular curvature of the elongated mounting trough in the support structure 946, as shown in FIGS. 29 and 37. As will be seen, this technique of using flexible platforms, flexible blade strips and flexible cover members which are conformed to the curvature of the mounting structure in which they are installed may be employed with the second through eighth embodiments described hereinafter as well.

Blade support platform 934, which is made of bendable plastic material, has its side profile and end cross-sectional profiles best shown in FIGS. 37 and 34, respectively. Platform 934 ends up being inserted directly into the curved trough of the base support structure 946, and thus assumes a generally curved shape complementary to the trough. As shown, in the razor blade shaving head 920, a first razor blade strip 945, blade spacers 932, a second curved razor blade strip 940 and a blade cap structure 930 are each provided, sequentially, upon and above blade support platform 934. Locking pins 931 each have an elongated shaft that passes through, and a pin head that is received in, respective spaced complementary recesses 933 within blade cap structure 930. These locking pins 931, shown to be five in number in FIG. 37, operate to secure blade cap structure 930, curved blade strips 940 and 945 and spacers 932 to blade support platform 934. A thin elongated lubricant strip 950 may be provided on the generally rounded top surface of blade cap structure 930 for lubricating the skin during use of this curved blade shaving device. As is well known in the art, lubricant strip 950 is typically constructed of a depletable lubricating substance that gradually wears away with use.

Figure 31:
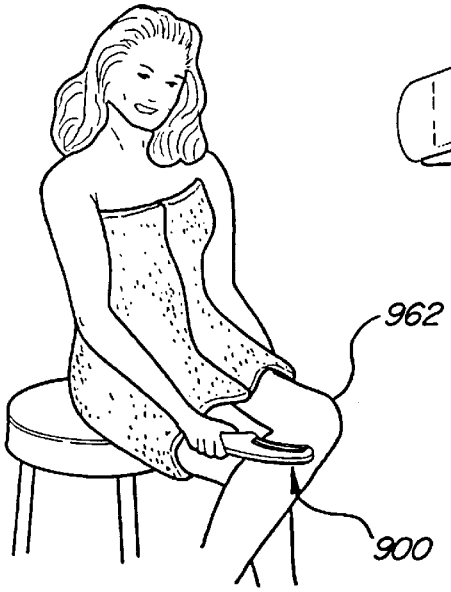

As shown in FIGS. 29, 31 and 36, curved razor blade device 900 may be used upon a curved skin surface 962 for the cutting of hairs 960 from that surface. It will be appreciated that the various components of the cutting structure previously described are curved so as to be advantageous for shaving the curved hairy surfaces of the body, such the lower legs, as shown in FIG. 31, or the thighs, as shown in FIG. 36. As mentioned elsewhere in the specification, it should be appreciated that, in designing this shaving device, the level of curvature may be suitably sculpted to help the curved razor blade shaving head substantially conform to typical curves found in the legs, arms or other areas of the human anatomy that are to be cleanly shaved.

As best seen in FIGS. 34 and 35, the curved hair razor blade device 900 is preferably constructed to have a plurality of razor blade strips 940 and 945, each provided with two opposed razor-sharp cutting edges. Razor blade strip 940 is narrower in width than razor blade strip 945. In this manner, and as best shown in FIGS. 35 and 36, a bidirectional hair shaving razor device results. Specifically, FIG. 35 illustrates, by its diagonal intersecting dashed lines, that the curved razor blade device 900 is constructed so as to include two curved working planes 970 and 980 for shaving. These working planes are established and defined by cooperation between the outer rounded edges of the blade support platform 934 and the flattened edge surfaces on either side of the apex of the cap member 930. In other words, one rounded outer edge and one flattened edge surface serve, as best shown in FIG. 36, as the rear and front guards of a curved safety razor, which are spaced in close proximity to the razor-sharp blade edges. In practice, these curved working planes may be formed in part as shown using the top rounded profile of the cap member 930 upon which the lubricant strip 950 sits. Preferably, the working planes 970 and 980 are established in a symmetrical fashion about the dashed vertical centerline shown in FIG. 35.

As also can be readily seen in FIG. 36, the working planes 970 and 980 have been designed to shave hairs when either of the working plane 970 or the working plane 980 is moved across a skin surface substantially coincident with and parallel to the skin surface, since, as shown, the sharpened razor blade edges are angled so as to be able to shave hair projecting from the skin. As shown in FIG. 36, the manual tilting of the curved hair razor blade device 900 to an angle to the right suitable for bringing the working plane 970 into contact with the skin, followed by tilting device 900 to an angle in an opposite direction (to the left in FIG. 36) so that working plane 980 comes into contact with the skin, allows the curved hair razor blade device 900 to shave bidirectionally, that is, upon sliding movement of the device along the skin in the direction of the tilt of the device. Thus, as shown in FIG. 36, a back-and-forth bidirectional shaving exercise can be accomplished using this device by alternatively tilting the curved hair razor blade device 900 in alternate directions and sliding the shaving head portion of device 900 in that direction along the skin surface. FIG. 31 shows the use of the curved hair razor blade device 900 upon a skin surface 962, such as a human leg. As can be seen best in FIG. 29, the curved profile of the double-bladed razor structure 920 can be substantially matched to the curvature of the leg portion to be shaved. Thus, tilting the razor blade device 900 from side to side as shown in FIG. 36, while manually moving the device 900 across the skin surface 962 in a back-and-forth motion, allows an area of skin surface 962 to be cleanly shaven from two opposite directions.

As can be best seen in FIGS. 34 through 36, the components of the curved razor blade platform structure 920 (which are shown in FIG. 37 from the side) are all constructed in a symmetrical configuration relative to or about the central vertical longitudinal plane of the device 900, which plane is indicated by the dashed vertical line of FIG. 35. In other words, lubricant strip 950, pins 931, blade cap structure 930, flexible razor blade strips 940 and 945, blade spacers 932 and blade support platform 934 are all symmetrically arranged about this longitudinal vertical plane. As can best be seen in FIGS. 34 and 35, the components from bottom to top are of increasing width, from the apex region of cap member 930, which is the outermost component, all the way to the innermost interior component, namely, the base support member 934 with its outer front guard edges that extend outwardly farthest from the vertical plane. This change in width from the outermost part, that is, the apex region of cap member 950, to the front guard edges of the blade support platform member 934, provides the two curved working planes 970 and 980 in which the sets of curved sharpened razor blade edges are positioned. Further, as best shown in FIG. 35, the curved working planes are substantially equiangularly disposed about the central vertical longitudinal plane of device 900. Those skilled in the art will appreciate that, in this arrangement, the two sets of sharpened razor blade edges are effective for shaving, since they are respectively positioned with their edges substantially in one of these two curved working planes, which follow along the curved front and rear guards formed by the front guard edges of platform 934 and the opposite angled sides of cap member 950, as shown best in FIG. 35.

Placing a pair of straight sharpened razor blade edges substantially in a straight working plane defined by nearby straight front and rear guards is well-known in the conventional T-bar safety razor blade art. Those skilled in the art should appreciate that the present construction shown in FIGS. 29–37 applies such principles to a curved hair razor blade device 900 having two sets of curved front and rear guards that define the curved working planes 970 and 980, in which the curved blade edges are situated, all as described above and shown in the Figures. These curved razor blade edges are formed in the FIG. 29 embodiment by the gentle bending of flexible razor blade strips 940 and 945 into alignment with the front guards, which occurs automatically when curved razor blade shaving head 920 of device 900 is assembled, since the curvature of the base support platform 934, blade strips 940 and 945, cap member 930 and even lubricant strip 950 are all dictated by, that is, they naturally follow the curvature of, the underlying base support structure. Specifically, the curvature of the trough into which the bottom of flexible platform 934 razor blade head structure 920 is inserted dictates the curve that these flexible members follow. Those skilled in the art should appreciate that the second through eighth embodiments of the body shaving devices of the present invention which are shown in detail in the following Figures and described in detail below make use of the same basic curved working plane architecture and other key features and principles of operation that have just been described in connection with the curved body shaving device 900 shown in FIGS. 29 through 37.

FIG. 35 also shows a particular feature of the blade support platform 934, where flow-through spaces or passages 935 are included at regular intervals. As can best be seen in FIG. 37 and FIG. 29, these spaces 935 are formed by the open regions between the spacers 932, and are also formed by the flat valleys between the flat mesa-like areas of flexible platform 934 containing the circular openings through which pins 931 pass. These flow-through openings 935 provide a location for hair stubble that is cut during the shaving process to accumulate. Openings 935 also serve as holes through which water may run when cut stubble is being rinsed away, such as occurs when using the well-known technique of holding a razor blade head of a shaving device under running water from a faucet to rinse away the shaving debris from a manual razor.

Figure 32:
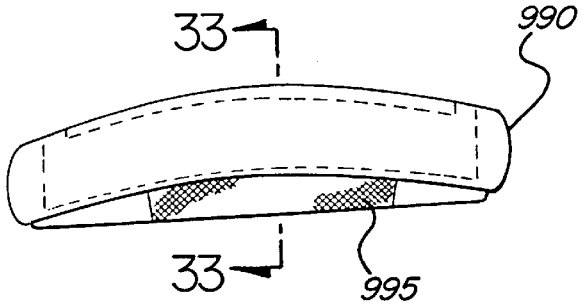
Figure 33:
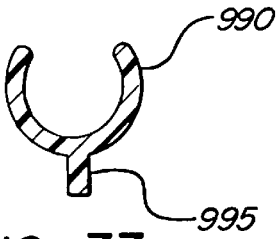

FIGS. 32 and 33 show a lightweight plastic storage cover 990 having a substantially cylindrical cross-section. Cover 990 includes a substantially flat projecting gripping portion 995 for facilitating placement and removal of the storage cover 990 on the razor blade structure 920. Although cover 990 may be made of plastic material, which is preferably transparent as indicated by the dotted lines, it should be appreciated that any other well-known material for covers found on manual shaving devices may be used.

FIG. 37 illustrates an enlarged exploded view of the components of the working portion of the curved hair razor blade device 900 which better illustrates details of their construction. FIG. 37 also shows that the razor cutting structure forming the curved razor blade head 920 of shaving device 900 is preferably an assembled structure, which can be installed by simply aligning and pressing together the various components. Specifically, as indicated, flexible blade strip 945, spacers 932, curved blade strip 940, and blade cap structure 930 can be assembled together and locked in place using multiple locking pins 931. The heads of pins 931 are preferably insertable within recesses 933 of blade cap structure 930. The shafts of pins 931 pass through corresponding holes in blade strips 940 and 945 and spacers 932, and are receivable within apertures 938 of blade support platform 934. In addition, lubricant strip 950 is preferably located upon the outer surface of blade cap structure 930 and thus covers the recessed heads of locking pins 931. The entire assembled razor blade structure 920 can then be secured in place upon base support structure 946 by fitting the elongated central base portion of support platform 934 of razor blade structure 920 into trough 947, which has a complementary generally rectangular cross-sectional shape, and is found in base support structure 946 (as best seen in FIG. 34). In addition, as best seen in FIG. 37, the projections 948 of the blade support platform 934 engage the tapered locking holes 949 located within the base support structure 946 to help hold platform 934 in place within the trough. As noted before, the curvature of elongated trough gives structure 920 its final curved shape.

Figures 38, 39:
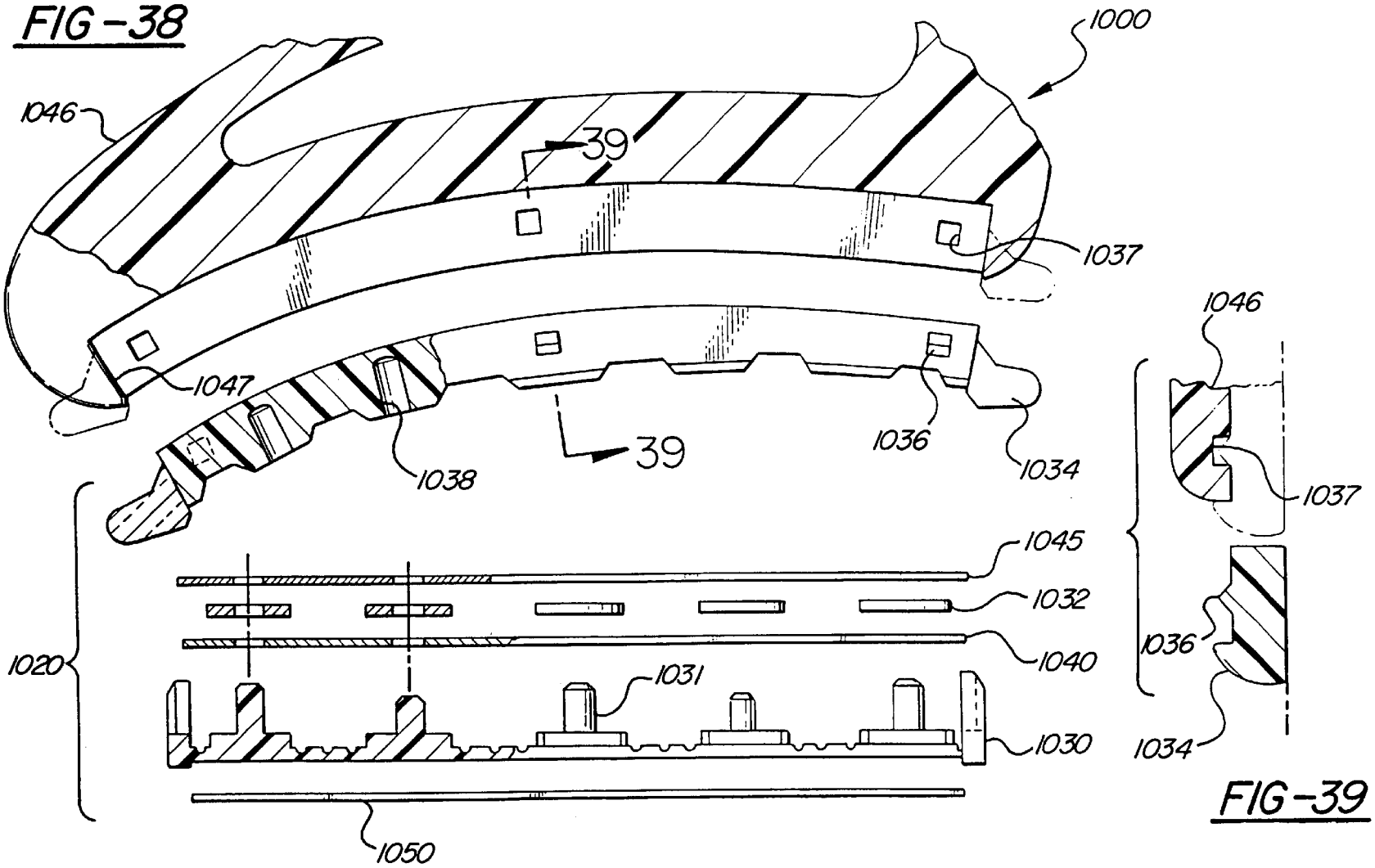
FIG. 38 illustrates a second construction for the longitudinally curved concave body shaving device of the present invention, and is an enlarged fragmentary exploded side elevational view of a second embodiment of the curved base support structure and a rigid cartridge-style curved razor blade strip platform structure, much like the FIG. 29 body shaving device in appearance, which cartridge includes from bottom to top—lubricant strip, interconnected flexible cover member with five integrally formed pin members, first razor blade strip, five flat, generally rectangular blade spacers, second razor blade strip, and substantially rigid plastic platform member, all of which form the cartridge structure, which is held in the base support structure by a plurality of wedges and slots, once inserted into the corresponding elongated generally rectangular trough of the base support structure.
FIG. 39 is an enlarged fragmentary transverse cross-sectional view of one wedge and slot taken along line 39—39 of FIG. 38, which helps illustrate how the platform member is removably locked into the rectangular trough of the base support member.

FIGS. 38 and 39 show a second embodiment 1000 of the longitudinally curved body hair shaving razor blade device of the present invention. This curved razor blade device 1000 includes a base support structure 1046 and is preferably integrally formed with a handle portion (not shown) of the type previously described in connection with the FIG. 29 device. This embodiment shows a slightly different configuration for the razor blade shaving head, namely, a cartridge structure 1020 that is removably attachable to its base support structure 1046. Specifically, cartridge structure 1020 includes a blade cap structure 1030 which includes integrally formed locking pins 1031, which are a substitute for the separately formed locking pins 931 that engaged the blade cap structure 930 in the previous embodiment. In similar manner as locking pins 931, locking pins 1031 are engaged with the blade cap structure 1030 so as to provide a surface for receiving a lubricant strip 1050. Disposed under blade cap structure 1030 are blade strip 1040, five spacers 1032, and blade strip 1045. These components fit upon locking pins 1031, and are bent to a curved configuration and mated with the blade support platform 1034, with locking pins 1031 being received within apertures 1038 of blade support platform 1034. This assembly completes the cartridge structure 1020. The cartridge structure 1020 is then removably disposed within an elongated curved trough 1047 of rectangular cross-section centrally located in the base support structure 1046. Structure 1020 is retained in place in part through the engagement of rectangular-shaped wedges 1036 with rectangular-shaped slots 1037 disposed upon base support structure 1046. As shown in FIG. 39, the engagement of wedges 1036 and slots 1037 allows platform 1034 of cartridge structure 1020 to be snap-fit into place within trough 1047. It may be subsequently removed by pulling cartridge structure 1020 away from base support structure 1046 with sufficient force to overcome the engagement between wedges 1036 and slots 1037. Alternatively, any other suitable releasable engagement mechanism well-known in the razor blade cartridge art may be utilized to removably secure cartridge structure 1020 into place within trough 1047. As before, the concave curvature of cartridge structure 1020 of this embodiment is especially useful for shaving convex skin surfaces of the body, such as the legs.

Figure 40:
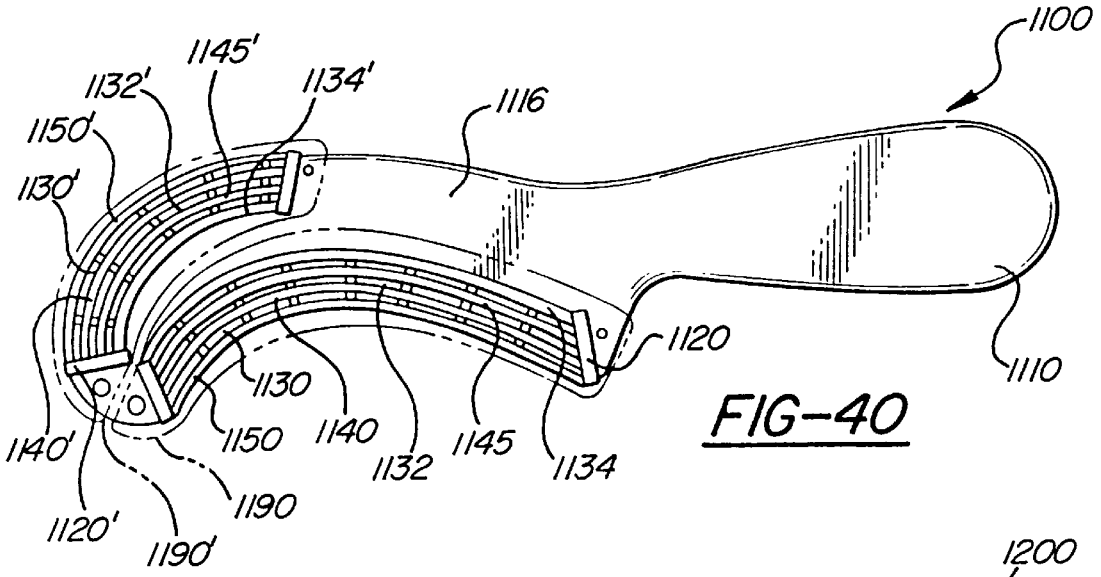
FIG. 40 is a side-elevational view of a third embodiment of my longitudinally arranged body shaving device which has a first concave razor blade platform structure similar to that shown in the first embodiment above (i.e., FIG. 29), but with a different complex concave curvature, and a second convex razor blade platform structure on the distal end portion of the device, which is suitable for shaving concave body regions such as the underarm areas, whose razor blade platform structure may be similarly formed, and further

FIG. 40 shows a third embodiment of the curved hair razor blade device of the present invention, generally at 1100. Razor blade device 1100 includes a handle portion 1110 and a longitudinally-arranged base support structure 1146 that is in line with handle 1100. Longitudinally arranged razor blade device 1100 includes two differently shaped curved razor blade head structures for facilitating shaving of differently contoured body surfaces. Specifically, device 1100 includes first and second curved longitudinally-arranged razor blade head structures 1120 and 1120'. First structure 1120 has a generally concave curvature when viewed in side elevation as shown, and is suitable for shaving legs and arms. Second structure 1120' is located upon the distal end of the base support structure 1146, and has a convex curvature when viewed in side elevation as shown. Structure 1120' is suitable for shaving concave body regions such as the underarm areas. Thus, razor blade device 1100 provides both concave and convex shaving surfaces for the shaving of convex and concave body surfaces, respectively, in a single device.

The construction of the curved razor blade head structures 1120 and 1120' are similar to the structures described in connection with FIG. 29 or with FIG. 30. Accordingly, the reference numerals for the associated components shown in FIG. 40 for the curved razor head are the same as for the components in FIG. 29, except are higher by 200, and are the same as the FIG. 38 device, but are higher by 100. In this regard, first head or cartridge structure 1120 and second head or cartridge structure 1120' are shown to include, respectively, from exterior to interior surfaces, lubricant strips 1150 and 1150', blade cap structures 1130 and 1130', blade strips 1140 and 1140', spacers 1132 and 1132', blade strips 1145 and 1145' and blade support platforms 1134 and 1134'. It should be appreciated that these curved razor blade strip structures may be assembled and kept fixed in place, as in the FIG. 29 curved razor blade strip structures, or may be made removable like the cartridge structure of the FIG. 38 device. Razor blade device 1100 may also be provided with form-fitting covers 1190 and 1190' whose locations are shown in phantom lines. These covers are preferably made of a transparent plastic material or may be made of any other suitable well-known material used to make razor blade covers. Covers 1190 and 1190' are separately removable from their respective cartridge structures 1120 and 1120' since, as shown by the phantom lines, they are not connected. Thus, by selectively removing the covers, one or both curved razor blade head structures may be uncovered as desired.

Figure 41:
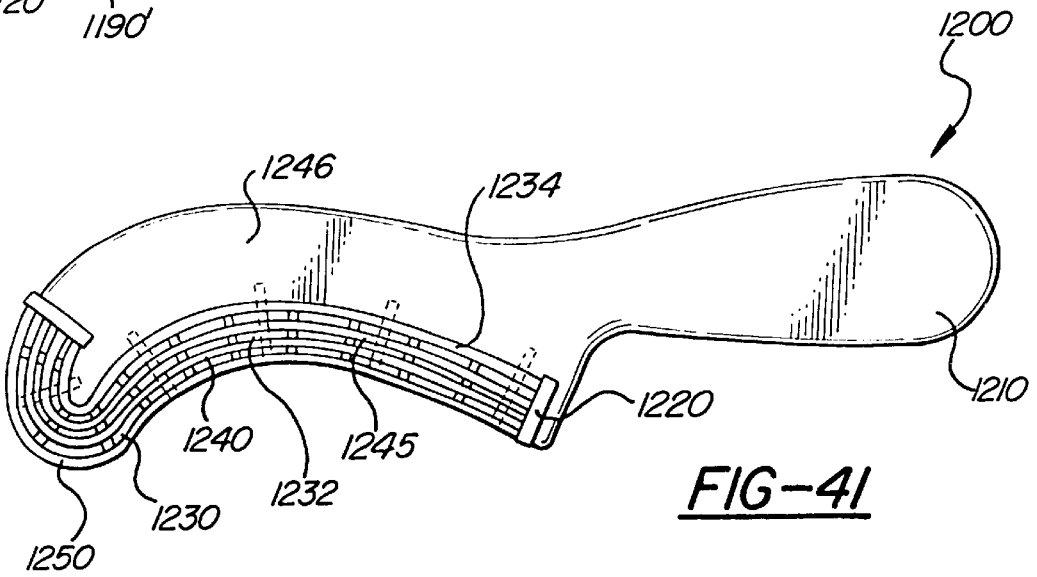
FIG. 41 shows a fourth embodiment of my longitudinally arranged body shaving device which has a complex compound razor blade platform structure having three regions of different curvature while the blade strips are centrally located in a common longitudinal plane, with the three regions being—a distal convexly curved razor blade strip region suitable for shaving underarm areas, a larger intermediate concavely curved razor blade portion suitable for shaving more rapidly curving body areas such as are found on the lower arms and legs, and a proximal razor blade portion which has a very slight concave profile, suitable for shaving gently curving body regions such as the thighs.

FIG. 41 shows another embodiment 1200 of my longitudinally arranged body shaving device, which has a razor blade platform structure with three regions of differing curvature. As before, this razor blade device 1200 includes an elongated handle portion 1210 and a base support structure 1246 arranged generally in line with one another. In this embodiment, a curved razor-blade head structure 1220 is provided that has a continuous complex curvature with three distinct regions. The first region is a distal convexly curved razor blade strip region suitable for shaving underarm areas. The second region is a larger intermediate concavely curved razor blade portion, which is suitable for shaving more rapidly curving body areas such as are found on the lower arms and legs. The third region is a proximal razor blade portion which has a very slight concave profile, suitable for shaving gently curving body regions such as the thighs. These three regions are formed in this embodiment from a single continuous curved razor blade strip structure 1220, which is suitably flexible for establishing the desired compound shapes when viewed in side elevation. Like devices 900 and 1000 of the previous embodiments, structure 1220 can be permanently assembled into base support structure 1246 or it may be constructed as a removable curved razor blade cartridge structure. As in the other embodiments, curved razor blade structure 1220 includes, from exterior to interior surfaces, lubricant strip 1250, blade cap structure 1230, blade strip 1240, spacers 1232, blade strip 1245, and blade support platform 1234.

Figure 42:
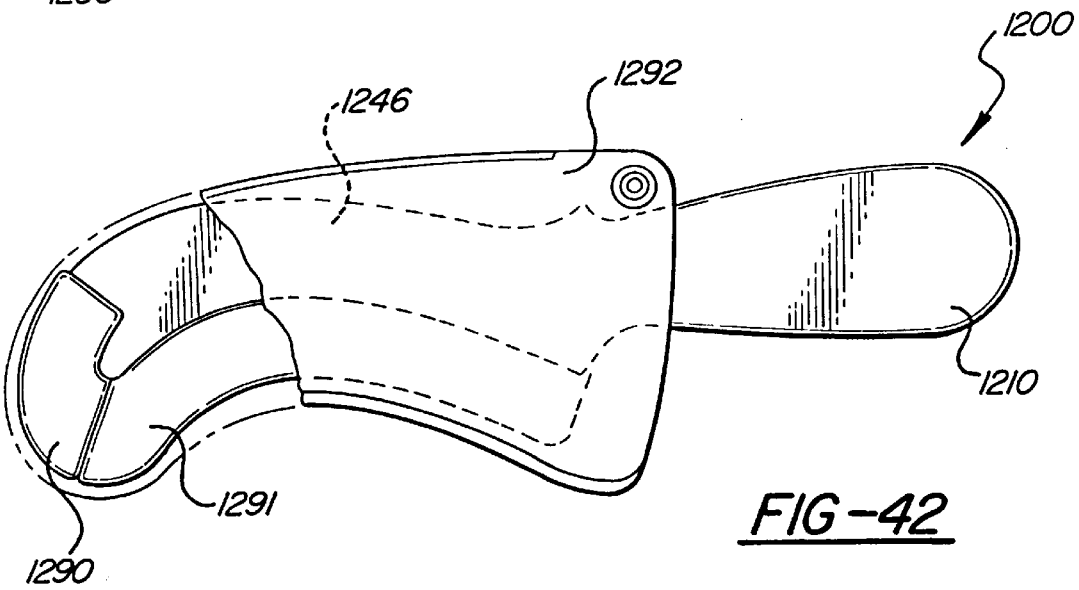
FIG. 42 illustrates that the FIG. 41 body shaving device may be provided with two removable generally hollow plastic razor blade covers respectively shielding the razor sharp edges of the blade strips in the distal region and in the intermediate and proximal regions of the FIG. 41 device, when those regions are not in use, and FIG. 42 also shows a lightweight polyethylene pouch into which the FIG. 41 device with covers installed thereon may be placed, and secured via a conventional snap adjacent the handle, as shown.

FIG. 42 illustrates the shape of two covers for curved razor blade head structure 1220, and the shape of a plastic storage pouch. In this Figure, blade covers 1290 and 1291 are provided, which are suitable for shielding structure 1220 in two sections, divided at the outermost portion of the convexly curved razor blade portion. As shown, blade cover 1290 shields the distal convexly curved razor blade strip region, and blade cover 1291 shields the proximal portion of the convexly curved razor blade strip region, the intermediate concavely curved razor blade portion and the proximal concave razor blade portion. Blade covers 1290 and 1291 may be attached or removed as desired to expose one or both sections of the cartridge structure 1220 for shaving purposes. In addition, a polyethylene storage pouch 1292 is shown for receiving the entire distal portion 1246 of razor blade device 1200. A conventional snap near the right end of pouch 1292 holds the pouch in place upon device 1200.

FIGS. 43, 44 and 45 illustrate a fifth embodiment of my longitudinally arranged body shaving device, namely, curved hair razor blade device 800 of the present invention. These Figures show in a side elevation and a cross-section, respectively, a blade support platform 834 supporting a plurality of curved elongated blade strips 840 and 845 having razor sharp edges, suitable spacers 832 between the platform and blade strips 840 and 845, and a blade cap structure 830 with locking pins 831 for interlocking the curved blade strips 840 and 845 to the blade support platform 834. In a preferred construction of this embodiment of the shaving device of the present invention, the razor sharp blade strips 840 and 845 are formed from continuous lengths of metal which extend substantially along the entire continuously curved surfaces as shown in FIG. 43. In particular, those skilled in the art should appreciate that FIG. 43 includes the following portions: a convex portion 816, a concave portion 820, and a substantially semi-circular arc portion 824.

FIG. 45 illustrates that a curved shaving region of device 800 may be made to be substantially straight for short distances if desired. In FIG. 45, the curved portion "A" of the embodiment shown in FIG. 43 is shown in phantom lines, while the substantially flat razor blade portion is shown in solid lines. Thus, FIG. 45 illustrates how a substantially flat razor blade portion may be provided as part of the FIG. 43 device, if desired, for shaving those hairy skin surfaces of the body which are substantially planar in nature, such as certain portions of the skin area directly adjacent the flat portions of the shin bone on the typical human leg. Although FIG. 45 shows only a single straight portion of limited length, those skilled in the art will appreciate that additional substantially straight portions of the continuous blade may be provided in the FIG. 43 embodiment if desired. The "french curve" razor blade shaving device 800 of the present invention shown in FIG. 43 also includes a handle portion 810. Portion 810 may take any suitable form, such as the elongated hand-grip style shown in FIG. 43, or any other suitable grip, including fingertip grips, flat grips and an arcuate hand grip having a passage or holes therethrough for receiving the fingers. The blades 840 and 845 may also be segmented as shown in FIG. 13E.

Figure 46:
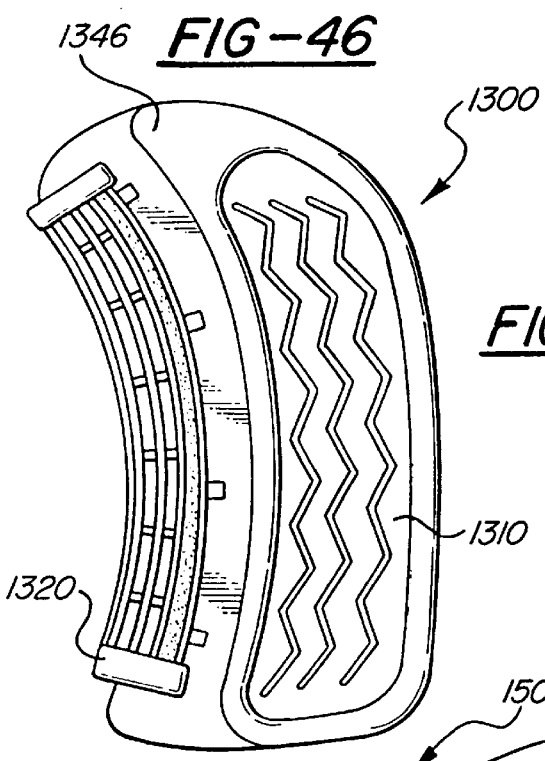
FIG. 46 is a side elevational view of a sixth embodiment of the longitudinally arranged body shaver of the present invention, which features a concave blade strip platform and a fingergrip portion opposite the blade strip platform, which fingergrip region is provided with a raised rim and wavy raised lines for improved finger gripping.

FIG. 46 shows, in a side elevational view, a sixth embodiment 1300 of the longitudinally arranged body shaver of the present invention. Curved razor blade shaving device 1300 has a unitary structure as shown that includes a generally concave base support structure 1346 with an integrated fingergrip portion 1310 having a somewhat textured surface as shown. Fingergrip portion 1310 is opposite a concave razor blade strip platform structure 1320. The fingergrip region 1310 is provided with a raised rim and wavy raised lines for improved finger gripping. Razor blade device 1300 is a more compact structure than those longer-handled devices of the previous embodiments. Curved razor blade structure 1320 is shown to be of similar configuration as those curved razor blade structures previously described, and is mounted as shown upon a side of the base support structure 1346.

Figure 47:
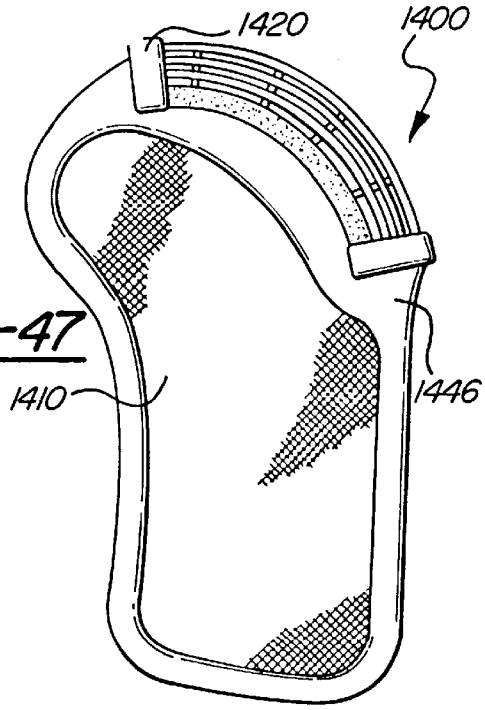
FIG. 47 is a seventh embodiment of the body shaving device of the present invention shown in side elevation which has a convexly curved blade strip platform suitable for shaving underarm areas, and a raised rim along the perimeter opposite the blade strip platform and a textured region within the rim perimeter provided with cross-hatching for improved finger gripping.

FIG. 47 shows a seventh embodiment 1400 of the body shaving device of the present invention. In this alternate embodiment, the curved razor blade device 1400 includes a base support structure 1446 with an integrated fingergrip portion 1410 having a textured cross-hatched surface for improved finger gripping. It also had a raised rim as shown, similar to the FIG. 46 embodiment. A curved razor blade structure 1420 of a generally convex configuration is located upon base support structure 1446. Structure 1420 is shown to be disposed along an upper end of base support structure 1446, as opposed to being along the side of the base support structure 1346 in FIG. 46. Thus, while razor blade device 1300 in FIG. 46 is useful for trimming convex surfaces such as the legs, razor blade device 1400 in FIG. 47 is useful for shaving concave body surfaces such as underarm areas. As shown, curved razor blade structure 1420 may be constructed in a manner substantially similar to the configuration of the curved longitudinally arranged razor blade structures previously described.

Figure 48:
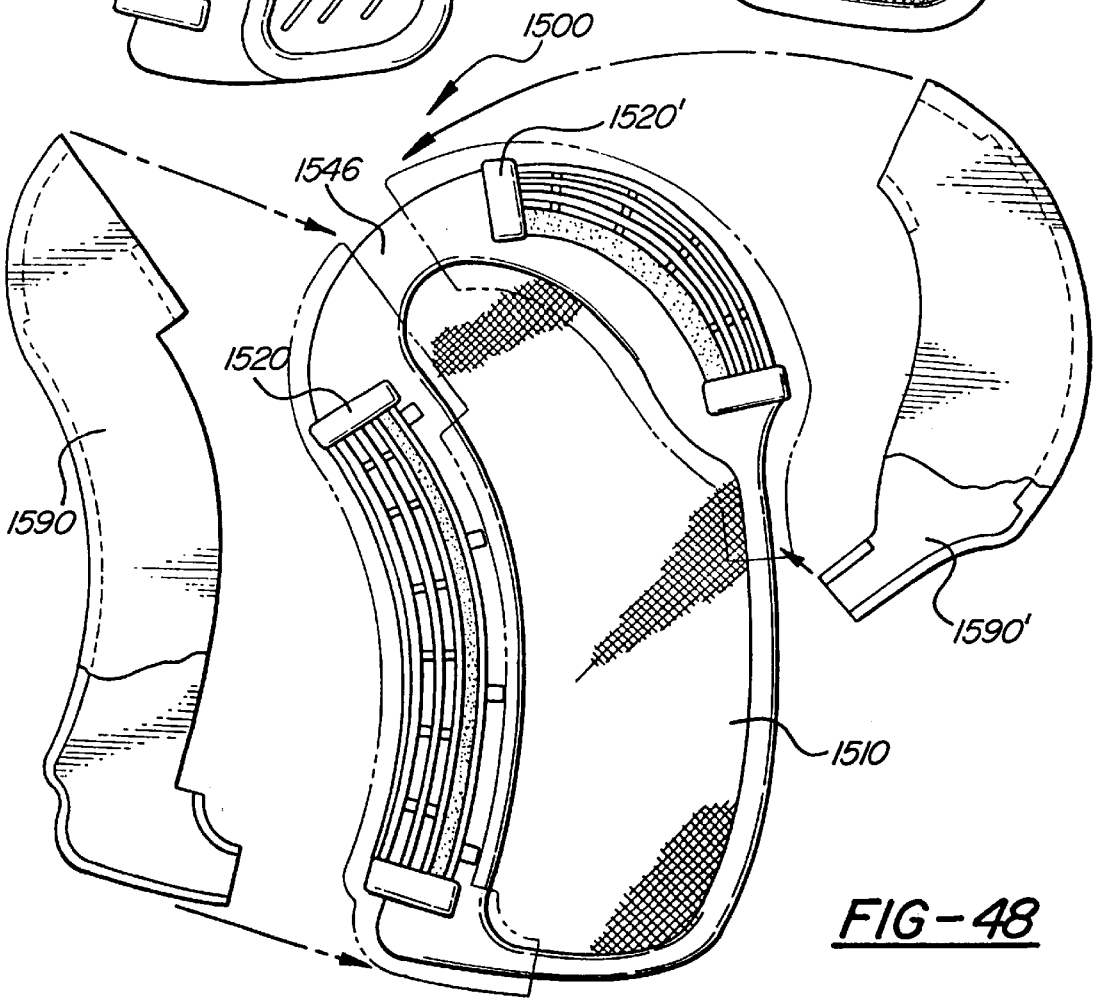
FIG. 48 shows an eighth embodiment of the longitudinally arranged body shaving device of the present invention which is essentially a combination of the sixth and seventh embodiments, since it has a concave blade strip platform and a convex blade strip platform, which is provided with two substantially hollow transparent plastic covers shown removed from the device with arrows pointing to the cover locations illustrated in phantom.

FIG. 48 is an eighth embodiment 1500 of the longitudinally arranged body shaving device of the present invention. It is essentially a combination of the sixth and seventh embodiments. Curved razor blade device 1500 includes a base support structure 1546 with a finger grip portion 1510 integrated thereupon. The finger grip portion 1510 is shown to have a textured surface as in embodiment 1400. Device 1500 includes two curved razor blade structures 1520 and 1520', located along one side and along an upper edge, respectively, of the base support structure 1546. As can be seen, these two curved razor blade structures 1520 and 1520' are like those structures 1320 and 1420 shown in FIGS. 46 and 47, and may be constructed accordingly. A pair of covers 1590 and 1590' are also provided for shielding one or both of razor blade head structures 1520 and 1520' as may be desired during shaving or during storage of device 1500. Covers 1590 and 1590' are preferably of a transparent plastic material as before, although it will be appreciated that any conventional well-known cover material used with manual safety razors may be used for these covers.

My razor-sharp nose hair trimming devices can each be implemented as a structure that is symmetrical or asymmetrical about an imaginary central longitudinal axis which extends through the forward blade-supporting portion and fingergrip portion. Unless otherwise indicated, the devices shown herein are symmetrical about the central plane of the overall device, in which the central longitudinal axis is found. Thus, those in the art should appreciate that the descriptions herein of one side, end, or section of any given cutting head or handle in general will also serve to describe the other half of said symmetrical structure on the opposite side of the central imaginary axis or central longitudinal plane.

The small overall size of the device permits fingertip holding, which results in better control of the cutting action. This enables the user to cut with a light touch as he (or she) trims the body hair in the cavity. Precise or detailed control and positioning is further facilitated by the light weight of the device.

With the cover, which can be cap-like or sleeve-like, which cover can be used with any of the described devices, a convenient nose hair trimming system is provided which is sanitary, safe, easily usable and sufficiently inexpensive that it may be discarded after a limited number of uses.

While the above embodiments have been described in connection with particular examples, it will be recognized that any of the features set forth with regard to any of the particular embodiments may be used with other embodiments and/or in combinations of other embodiments to accomplish the desired result.

Further, although the foregoing embodiments are discussed with respect to the nostril hair trimming, those skilled in the art will appreciate that these same devices may also be used for trimming hair within any close quarters, such as within or near certain small body cavities of humans or animals. Examples of such close quarters include human or animal ears and within animal paws. Thus, the device of the present invention is intended to be applicable to a wide variety of applications for both human and animal care (such as certain breeds of dogs that have hair growing within their outer ears) or other parts of a person's or an animal's body where small depressions or cavities are present where hair to be trimmed is present. Also, those in the art will appreciate that barbers, health care professionals, geriatric attendants and other care-givers may safely use the shaving trimmers of the present invention to cut the nostril and/or ear hair of their customers and/or patients.

Those skilled in the field will appreciate that the foregoing illustrated and discussed embodiments of the shaving devices of the present invention are subject to modification and change without departing from the scope of the invention as recited in the claims below. Needless to say, the overall size, proportion, materials, weight and clearances of the various components used in the razor-holding portions, the fingergrip sized portions, and connection mechanisms for attaching the blade strip to the body of the shaving devices of the present invention can be varied as needed or desired. A number of other possible modifications have already been described above. Further changes are clearly possible, as different features and aspects of one embodiment may be combined with another embodiment to provide a nose hair trimming device with the desired features from both.

While the foregoing embodiments have been described above particularly with respect to nose hair trimming applications, those skilled in the art should appreciate that the broader aspects of the present invention are by no means limited to shaving hair from the small cavities within the body such as the nostrils or ears. Instead, the present invention of a razor sharp curved blade structure with suitable blade guards and/or blade platforms can be applied to shave larger areas of the body, such as the curved surfaces of the legs, arms and under the arm or behind the knees. In order to implement such as structures, the embodiments described above are enlarged, and can be provided with additional complex curves of either convex or concave proportions matching those typically found in the aforementioned curved hairy parts of the human anatomy. For example, human legs or arms, which are shaved either for health reasons (such as during surgery) or for cosmetic or beauty reasons, the curved portions of the enlarged structures can be suitably sculpted to conform to typical curves found in these or other areas of the human anatomy to be cleanly shaved.

Thus, it is to be understood that the present invention is by no means limited to the particular constructions herein disclosed and/or shown in the drawings. Instead, the present invention also encompasses any modifications or equivalents within the scope of the disclosures that are fairly covered by the claims set forth below.

I claim:

1. A curved-blade shaving device having a curved razor blade strip arrangement for shaving hair from curved body surfaces such as legs and arms, the shaving device comprising:

a thin elongated razor blade strip platform structure having a length, height and width and a plane of reference, hereinafter called the common plane, oriented along its length and height, and having elongated front and rear guard members which are curved when the shaving device is viewed in side elevation from a point spaced from and perpendicular to the common plane, the front guard member being arranged along and about a front plane spaced from and substantially parallel to the common plane, the rear guard member being arranged along and about a rear plane substantially parallel to the common plane;

a hand grip portion of predetermined shape having a length, height and width and arranged along its length and height substantially along the common plane;

an elongated curved base support structure having a length, height and width and being arranged with its length and height substantially along the common plane, and wherein the base support structure is rigidly connected to the hand grip portion, with the length of the base support structure and the length of the hand grip portion being generally parallel to one another, the base support structure is connected to and supports the platform structure for movement across curved skin surface areas of a user's body to be shaved with the device, the platform structure further includes at least one elongated generally ribbon-like very thin flexible razor blade strip having at least one elongated razor-sharp blade edge for shaving hair which extends along and is positioned in close relation between, but is spaced from the front and rear guard members, and when the platform structure is attached to the curved base support structure, a curved working plane is defined by and present through the cooperation of the front and rear guard members, with the guard members and razor blade strip being maintained in a generally curved configuration and with the razor-sharp blade edge being both in a plane substantially parallel to the common plane and projecting at an acute angle into the curved working plane, whereby the curved-blade shaving device is useful for shaving hair from skin on curved body portions having a substantially similar contour to the curved working plane using the curved razor-sharp blade edge located between the front and rear guard members.

2. The curved-blade shaving device according to claim 1, further comprising a first cover for shielding at least a substantial portion of the elongated blade strip platform structure, thereby covering a substantial portion of the razor-sharp edge.

3. The curved-blade shaving device according to claim 1, wherein the elongated blade strip platform structure includes both concave and convex portions as distinct portions of a substantially continuous structure.

4. The curved-blade shaving device according to claim 1, comprising first and second elongated blade strip platform structures as recited above attached to the base support structure at different elongated sections thereof located along the common plane.

5. The curved-blade shaving device according to claim 4, wherein the first elongated blade strip platform structure is attached to the base support structure in a substantially concave configuration suitable for the shaving of a convex skin surface and the second elongated blade strip platform structure is attached to the base support structure in a substantially convex configuration suitable for the shaving of a concave skin surface.

6. The curved-blade shaving device according to claim 1, wherein:

the elongated blade strip platform structure is releasably attached to the base support structure, and the base support structure has a substantial portion thereof provided with a generally convex configuration when viewed from the side elevation, such that the curved-blade shaving device is suitable for the shaving of a skin surface having a generally concave cross-section.

7. The curved-blade razor shaving device according to claim 1, wherein the razor-sharp blade edge is centrally positioned between the front and rear guard portions, and the razor-blade strip has generally flat opposed surfaces that are arranged perpendicularly to the common plane.

8. The curved-blade shaving device according to claim 1, wherein:

the hand grip portion extends along its length as an elongated in-line formation generally connected from one end only of the base support structure, the hand grip portion has at least first and second elongated opposed grip surfaces configured to be readily grippable by a user's hand whose fingers wrap substantially around the hand grip portion and whose thumb is positioned on the first elongated grip surface and whose wrapped fingers are positioned on the second elongated grip surface.

9. The curved-blade shaving device according to claim 8, wherein the hand grip portion has a basic shape for its transverse cross-section along most of its length, with the basic shape of the transverse cross-section being selected from the group of basic shapes consisting of rectangles, squares and flattened ovals.

10. The curved-blade shaving device according to claim 1, wherein:

the elongated blade strip platform structure is constructed as a flexible structure, and is operable for being flexed from a substantially flat configuration, which it is normally in when not in the shaving device, into the generally curved configuration when it is mounted upon the curved base support structure, where it thereafter remains in the generally curved configuration for as long as it remains mounted upon the base support structure.

11. The curved-blade shaving device according to claim 1, wherein the elongated blade strip platform structure is constructed as an elongated cartridge that is removably attachable to the curved base support structure, thereby facilitating replacement of that cartridge with another identical cartridge when the razor-sharp edge dulls after a period of use.

12. The curved-blade shaving device according to claim 11, wherein:

the platform structure includes a platform which has at least one substantially rigid member having at least one elongated curved surface, and the curved base support structure has connecting structure which is complementary to and arranged to removably receive the rigid member, thereby facilitating replacement of that cartridge with another identical cartridge when the razor-sharp edge dulls after a period of use.

13. The curved-blade shaving device according to claim 11, wherein:

the blade strip platform has a pair of curved elongated front guard members arranged as generally opposed outer elongated guard portions spaced substantially equidistantly from and on opposite sides of the common plane, the rear guard member has a pair of generally opposed curved elongated inner guard portions spaced substantially equidistantly from and on opposite sides of the common plane, the blade strip structure includes a second elongated razor blade strip, the first and second blade strips each having a pair of substantialy parallel, generally opposed elongated razor-sharp blade edges for shaving hair, and generally opposed curved working planes for shaving are established through the cooperation of the generally opposed outer guard portions of the blade strip platform and generally opposed inner guard portions of the rear guard member, with the generally opposed razor-sharp blade edges of each blade strip respectively extending into the opposed curved working planes, and with the outer guard portions of the blade strip platform structure and the inner guard portions of the rear guard member being disposed in spaced relation from the nearest razor-sharp blade edges.

14. The curved-blade shaving device according to claim 13, wherein:

the cartridge comprises, from an exterior surface to an interior surface thereof, and in generally increasing width from the exterior surface to the interior surface, the rear guard member, the first blade strip, the second blade strip, and the blade strip platform structure, the first and second blade strips each having a respective uniform width between its opposed razor-sharp edges, the width of the second blade strip being greater than the width of the first blade strip, such than the opposed razor-sharp blade edges of the first and second blade strips project substantially into the two opposed curved working planes for the shaving of hair, and the hand grip portion extends along its length as an elongated in-line formation generally connected from one end only of the base support structure.

15. The curved-blade shaving device according to claim 11, wherein:

the curved base support structure includes two elongated side portions and a generally open elongated trough formed between those two elongated side portions, and the cartridge is releasably attached to the base support structure by having a portion thereof being inserted at least partially within the trough.

16. The curved-blade shaving device according to claim 1, wherein:

the elongated blade strip platform structure is releasably attached to the curved base support structure, and the base support structure has at least a major portion thereof with a generally concave configuration when viewed from the side elevation, whereby the curved-blade shaving device is suitable for the shaving of a skin surface having a generally convex cross-section.

17. The curved-blade shaving device according to claim 1, wherein:

the blade strip platform structure has at least one outer edge portion forming at least part of the front guard member, and the platform structure includes at least one cap member forming at least part of the rear guard member, and at least a second elongated blade strip supported by the platform structure, the second blade strip having at least one razor-sharp elongated blade edge for shaving hair disposed in spaced proximity to the elongated blade edge of the first blade strip and arranged so that the razor-sharp elongated blade edge of the second blade strip projects substantially into and runs along and curves with the curved working plane.

18. The curved-blade shaving device according to claim 1, wherein:

the blade strip support platform has a pair of curved elongated front guard members arranged as generally opposed elongated outer guard portions along respective front planes spaced from, on opposite sides of, and substantially parallel to the common plane, the rear guard member has a pair of generally opposed curved elongated inner guard portions arranged along respective rear planes spaced from, on opposite sides of, and substantially parallel to the common plane, the elongated razor blade strip has a pair of generally opposed elongated razor-sharp blade edges which blade edges, when the razor blade strip is maintained in the generaliy curved configuration, are arranged along respective planes spaced from, on opposite sides of, and substantially parallel to the common plane, and generally opposed curved working planes for shaving are established through the cooperation of the generally opposed outer guard portions of the blade strip platform and generally opposed inner guard portions of the rear guard member, with the generally opposed razor-sharp blade edges being respectively extending into the opposed curved working planes, and with the outer guard portions of the blade strip platform and the inner guard portions of the rear guard member being disposed in spaced relation from the nearest razor-sharp blade edges.

19. The curved-blade shaving device according to claim 18, wherein the blade strip platform is arranged for shaving of hair from skin in first and second opposite directions by having the generally opposed first and second curved working planes generally arranged at a nominal angle to one another, such that the respective curved working planes if extended beyond both inner guard portions of the rear guard member would intersect one another substantially at the common plane, and such that, when the shaving device is tilted generally in the first direction from a position where the common plane is vertical to a first angle substantially equal to one-half of the nominal angle, the first curved working plane of the device is placed substantially tangent to the curved skin surface to be shaved, whereby the device then may be moved in the first direction so that the first razor-sharp blade edge shaves hair from the skin, and such that when the shaving device is tilted generally in the second direction from a position where the common plane is vertical to a second angle substantially equal to one-half of the nominal angle, the second curved working plane of the device is placed substantially tangent to the curved skin surface to be shaved, whereby, the device then may be moved in the second direction opposite the first direction, so that the second razor-sharp blade edge shaves hair from the skin.

20. The curved-blade shaving device according to claim 18, wherein:

the curved base support structure and the elongated blade strip platform structure have a symmetrical configuration about the common plane, with the common plane being centrally located between the generally opposed razor-sharp edges.

21. The curved-blade shaving device according to claim 20, wherein:

the pair of generally opposed outer guard portions of the blade strip platform are spaced equidistantly from the common plane, the generally opposed razor-sharp blade edges of each razor blade strip are spaced equidistantly from the common plane, and the pair of generally opposed inner guard portions of the rear guard member are spaced equidistantly from the common plane.

22. The curved-blade shaving device according to claim 1, wherein:

the platform structure includes an elongated platform and the front guard member is formed as part of an outward extension of the platform that extends in a direction away from the common plane, the front guard member having at least one elongated edge portion.

23. The curved-blade shaving device according to claim 22, wherein:

the curved base support structure includes an elongated front portion and an elongated rear portion generally arranged along the common plane, and the front portion has a connection region to which the elongated blade strip platform structure is releasably attached, and the rear portion is integrally formed with the hand grip portion of rigid material.

24. The curved-blade shaving device according to claim 1, wherein:

the razor-sharp blade edge defines a concave curve over at least a substantial portion of its overall length, and the curved-blade shaving device is arranged and constructed to be operable for shaving a horizontally positioned leg portion of a body upon tilting the platform structure in a first direction from a position where the common plane is vertical to a substantial angle from the vertical that brings at least a portion of the curved working plane generally into tangential contact with a curved skin surface and moving the curved-blade shaving device across the skin surface in the first direction.

25. The curved-blade shaving device according to claim 24, wherein:

the curved base support structure includes a front portion having a connection region to which the elongated blade strip platform structure is releasably attached, and an elongated rear portion arranged along the common plane to which the hand grip portion is connected.

26. The curved-blade shaving device according to claim 25, the platform structure further comprising an elongated cap member disposed at least in part over the elongated razor blade strip, and wherein:

the rear guard member is formed as part of the cap member, and the connection region includes a pre-formed surface topology into which the platform structure at least partially engages.

* * * * *